US010573966B2

(12) United States Patent
Ko et al.

(10) Patent No.: US 10,573,966 B2
(45) Date of Patent: Feb. 25, 2020

(54) METHOD AND APPARATUS FOR EFFICIENTLY TRANSMITTING BEAM IN WIRELESS COMMUNICATION SYSTEM

(71) Applicants: Samsung Electronics Co., Ltd, Gyeonggi-do (KR); Inha University Research and Business Foundation, Incheon (KR)

(72) Inventors: Seungtae Ko, Gyeonggi-do (KR); Jungsuek Oh, Incheon (KR); Young Ju Lee, Seoul (KR)

(73) Assignees: Samsung Electronics Co., Ltd., Suwon-si (KR); Inha University Research and Business Foundation, Incheon (KR)

( * ) Notice: Subject to any disclaimer, the term of this patent is extended or adjusted under 35 U.S.C. 154(b) by 405 days.

(21) Appl. No.: 15/462,666

(22) Filed: Mar. 17, 2017

(65) Prior Publication Data

US 2017/0271762 A1 Sep. 21, 2017

(30) Foreign Application Priority Data

Mar. 17, 2016 (KR) ..... 10-2016-0032132

(51) Int. Cl.
*H01Q 3/46* (2006.01)
*H01Q 3/36* (2006.01)

(52) U.S. Cl.
CPC ..... *H01Q 3/46* (2013.01); *H01Q 3/36* (2013.01)

(58) Field of Classification Search
CPC ..... G01S 15/8984; G01S 2007/4086; G01S 7/4017; G01S 7/4052; G01S 7/52046; G01S 7/52085
USPC ..... 342/372
See application file for complete search history.

(56) References Cited

U.S. PATENT DOCUMENTS 5,943,159 A * 8/1999 Zhu ..... G02F 1/292 359/254
6,556,349 B2 4/2003 Cox et al.
7,916,082 B1 * 3/2011 Herting ..... H01Q 3/267 342/368
2001/0020914 A1 * 9/2001 Roederer ..... H01Q 3/46 342/371
2003/0122709 A1 * 7/2003 Jeon ..... G01S 3/023 342/372
2004/0189933 A1 9/2004 Sun et al.
(Continued)

*Primary Examiner* — Timothy X Pham

(57) ABSTRACT

The present disclosure relates to a pre-5$^{th}$-Generation (5G) or 5G communication system to be provided for supporting higher data rates Beyond 4$^{th}$-Generation (4G) communication system such as Long Term Evolution (LTE). The present disclosure relates to a pre-5th-generation (5G) or 5G communication system to be provided for supporting higher data rates Beyond 4th-generation (4G) communication system such as long term evolution (LTE). According to various embodiments of the present disclosure, an apparatus in a wireless communication system comprises an antenna array configured to steer a first beam using antenna elements, and a lens including a first focal point and a second focal point. The lens is configured to generate a second beam of a plane wave by compensating for a phase error of the steered first beam passing through at least one of the first focal point or the second focal point.

18 Claims, 19 Drawing Sheets

(56) References Cited

U.S. PATENT DOCUMENTS

| | | | | |
|---|---|---|---|---|
| 2008/0079625 | A1* | 4/2008 | Weems | G01S 7/20 342/22 |
| 2010/0207833 | A1 | 8/2010 | Toso et al. | |
| 2012/0154203 | A1* | 6/2012 | Vacanti | G01S 7/03 342/149 |
| 2014/0313090 | A1 | 10/2014 | Oh et al. | |
| 2015/0009080 | A1 | 1/2015 | Oh et al. | |
| 2015/0200452 | A1 | 7/2015 | Oh et al. | |

* cited by examiner

METHOD AND APPARATUS FOR EFFICIENTLY TRANSMITTING BEAM IN WIRELESS COMMUNICATION SYSTEM

CROSS-REFERENCE TO RELATED APPLICATION(S) AND CLAIM OF PRIORITY

The present application is related to and claims the priority under 35 U.S.C. § 119(a) to Korean Application Serial No. 10-2016-0032132, which was filed in the Korean Intellectual Property Office on Mar. 17, 2016, the entire content of which is hereby incorporated by reference.

TECHNICAL FIELD

The present disclosure relates to a method and an apparatus for transmitting a beam in a wireless communication system.

BACKGROUND

To meet the demand for wireless data traffic having increased since deployment of $4^{th}$ generation (4G) communication systems, efforts have been made to develop an improved $5^{th}$ generation (5G) or pre-5G communication system. Therefore, the 5G or pre-5G communication system is also called a 'Beyond 4G Network' or a 'Post LTE System'.

The 5G communication system is considered to be implemented in higher frequency (mmWave) bands, e.g., 60 GHz bands, so as to accomplish higher data rates. To decrease propagation loss of the radio waves and increase the transmission distance, the beamforming, massive multiple-input multiple-output (MIMO), Full Dimensional MIMO (FD-MIMO), array antenna, an analog beam forming, large scale antenna techniques are discussed in 5G communication systems.

In addition, in 5G communication systems, development for system network improvement is under way based on advanced small cells, cloud Radio Access Networks (RANs), ultra-dense networks, device-to-device (D2D) communication, wireless backhaul, moving network, cooperative communication, Coordinated Multi-Points (CoMP), reception-end interference cancellation and the like.

In the 5G system, Hybrid FSK and QAM Modulation (FQAM) and sliding window superposition coding (SWSC) as an advanced coding modulation (ACM), and filter bank multi carrier (FBMC), non-orthogonal multiple access (NOMA), and sparse code multiple access (SCMA) as an advanced access technology have been developed.

Recently, wireless communication schemes that enable the transmission and reception of data in gigabytes per second using millimeter waves (mmWave) have received attention. When millimeter waves are used, a high-gain antenna is required in order to compensate for loss in air. A phased array antenna using a lens is available to obtain a high gain and to transmit a beam in different directions. However, the lens concentrates only a beam transmitted in a specified direction to amplify a gain, thus reducing coverage in which beams transmitted in different directions reach a destination with a high gain.

SUMMARY

To address the above-discussed deficiencies, it is a primary object to provide a method and an apparatus for efficiently transmitting a beam in a wireless communication system.

Exemplary embodiments of the present disclosure provide a method and an apparatus for extending coverage in which beams transmitted in different directions reach a destination with a high gain.

Exemplary embodiments of the present disclosure provide a method and an apparatus for forming a lens with a plurality of focal points.

Exemplary embodiments of the present disclosure provide a method and an apparatus for adaptively generating a focal point in a lens or adaptively relocating the focal point to a different position.

According to various embodiments of the present disclosure, an apparatus in a wireless communication system comprises an antenna array configured to steer a first beam using antenna elements, and a lens including a first focal point and a second focal point. The lens is configured to generate a second beam of a plane wave by compensating for a phase error of the steered first beam passing through at least one of the first focal point or the second focal point.

According to various embodiments of the present disclosure, a method for operating a transmitting end in a wireless communication system comprises steering, by an antenna array, a first beam using antenna elements, and generating a second beam of a plane wave by compensating for a phase error of the steered first beam passing through at least one of a first focal point or a second focal point comprised in a lens.

A transmitting apparatus according to exemplary embodiments of the present disclosure may provide a wide-coverage beam with a high gain through a lens with a plurality of focal points.

Further, the transmitting apparatus according to exemplary embodiments of the present disclosure may transmit beams with a high gain in different directions by adaptively generating or relocating a focal point of the lens.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 19B, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged electronic device.

The following description with reference to the accompanying drawings is provided to assist in a comprehensive understanding of embodiments of the disclosure as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of embodiments of the present disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Hereinafter, the present disclosure will describe a technology for multi-user reception in a wireless communication system.

Terms used in the following description, such as a term referring to control information, a term referring to a window start point, a term referring to a state change, a term referring to network entities, a term referring to a component of a device, a term referring to a filter, and the like are illustrated for convenience of explanation. Therefore, the present disclosure is not limited to the following terms, and other terms having equivalent technical meanings may be used.

Figure 1:
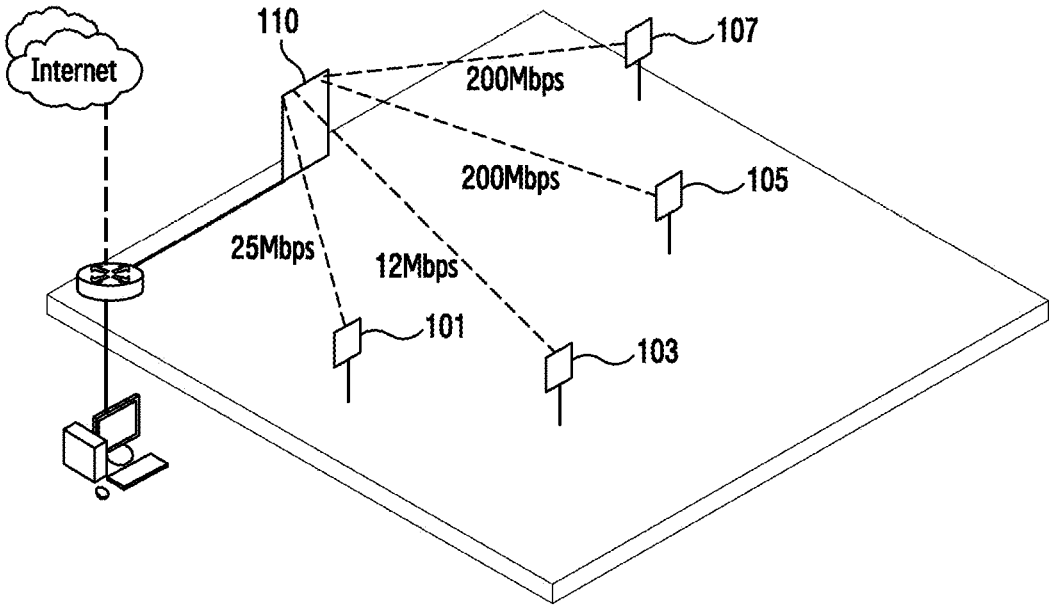
FIG. 1 illustrates an example wireless backhaul system according to an exemplary embodiment of the present disclosure.

FIG. 1 illustrates an example wireless backhaul system according to an exemplary embodiment of the present disclosure.

Referring to FIG. 1, the wireless backhaul system includes a transmitting end 110 and receiving ends 101, 103, 105, and 107. The transmitting end 110 may be a base station or a server. Each of the receiving ends 101, 103, 105, and 107 may be an electronic device that communicates with the transmitting end 110. The electronic device may include, for example, at least one of a smartphone, a tablet personal computer (PC), a mobile phone, a videophone, an e-book reader, a desktop PC, a laptop PC, a netbook computer, a workstation, a server, a personal digital assistant (PDA), a portable multimedia player (PMP), an MP3 player, a mobile medical device, a camera, and a wearable device. Contrary to FIG. 1, the transmitting end 110 may function as a receiving end, and each of the receiving ends 101, 103, 105, and 107 may function as a transmitting end. Each of the receiving ends 101, 103, 105, and 107 may be a base station. Lines drawn between the transmitting end 110 and the receiving ends 101, 103, 105, and 107 may indicate, for example, wireless backhaul links. The transmitting end 110 may perform data transmission and reception via a wireless backhaul link to each of the receiving ends 101, 103, 105, and 107. Although not shown, wireless backhaul links may be formed between the receiving ends 101, 103, 105, and 107, and the receiving ends 101, 103, 105, and 107 may perform data transmission and reception with each other through the wireless backhaul links. In order to efficiently use limited frequency resources and to achieve a high data transmission rate, the transmitting end 110 may transmit data through a wireless backhaul link using an extremely high frequency (e.g., millimeter wave (mmWave)) band. FIG. 1 illustrates speeds at which the transmitting end 110 transmits data through the wireless backhaul links to the respective receiving ends 101, 103, 105, and 107. However, these illustrated data transmission speeds are merely examples, and the transmitting end 110 may transmit data at data speeds required by the receiving ends 101, 103, 105, and 107.

When the transmitting end 110 transmits and receives data through a wireless backhaul link using an extremely high frequency band, beamforming may be used to reduce the path loss of radio waves and to increase the transmission distance of radio waves. Beamforming may include, for example, steering beams transmitted from an antenna to point in a specified direction. For beamforming, the transmitting end 110 may adjust the phases and strengths of respective signals transmitted and received through an antenna. Hereinafter, the expressions "transmits or receives a beam" and "transmits or receives radio waves" may be used to indicate the same or similar meanings in the present patent document.

Figure 2:
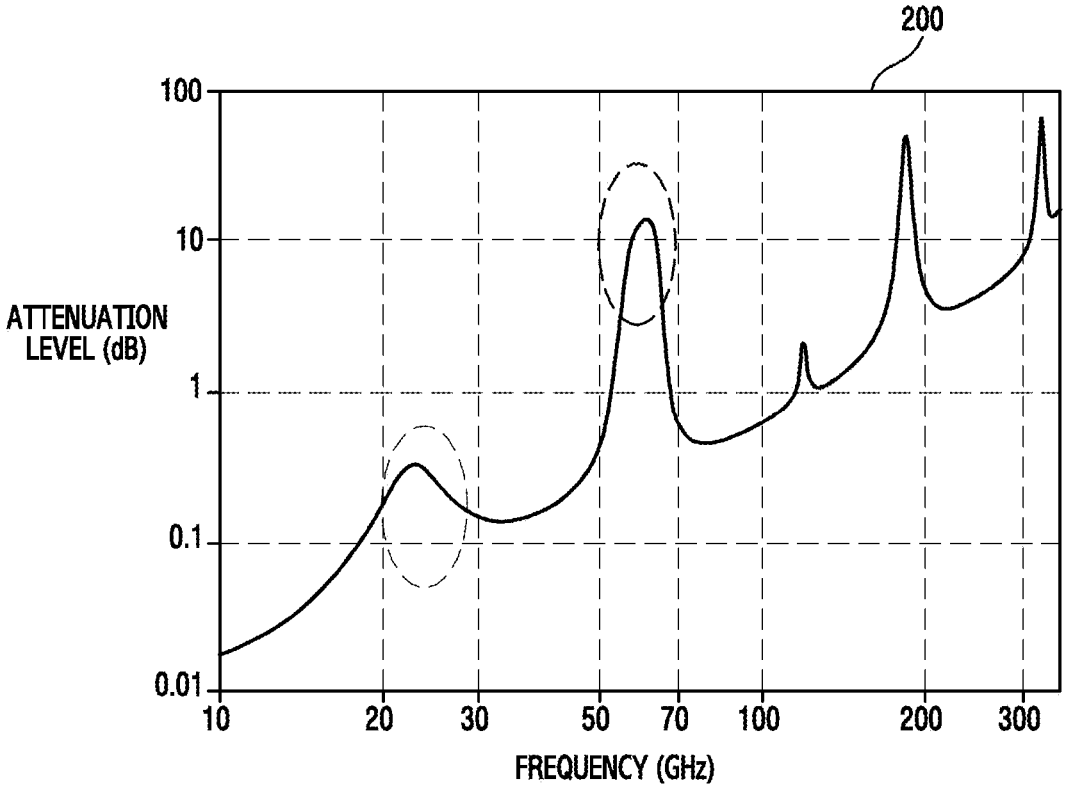
FIG. 2 illustrates an example radio-wave attenuation level in air based on a frequency according to an exemplary embodiment of the present disclosure.

FIG. 2 illustrates an example graph of a radio-wave attenuation level in air based on a frequency according to an exemplary embodiment of the present disclosure.

Referring to FIG. 2, the horizontal axis in the graph 200 represents a frequency. The frequency on the horizontal axis in the graph 200 is expressed in gigahertz (GHz). The vertical axis in the graph 200 represents an attenuation level according to distance. The radio-wave attenuation level may indicate the extent to which the power of a radio wave decreases every time the radio wave propagates 1 meter. The vertical axis in the graph 200 is expressed in decibel (dB).

The graph 200 shows that the radio-wave attenuation level increases with a higher frequency of the radio wave. That is, the graph 200 shows that the frequency of the radio wave has a positive correlation with the radio wave attenuation level.

In FIG. 2, the radio-wave attenuation level in air roughly increases with a higher frequency of the radio wave but does not monotonically increase. That is, the radio-wave attenuation level drastically increases and then decreases in some frequency bands. According to the graph 200, the radio-wave attenuation level drastically increases in a frequency band from about 20 GHz to about 30 GHz and a frequency band from about 50 GHz to about 70 GHz.

In the wireless backhaul system shown in FIG. 1, a base station may perform data transmission and reception using a mmWave band in order to efficiently use limited frequency resources and to achieve a high data transmission rate. The mmWave band may correspond to an approximately 60-GHz band. A signal transmitted from the base station is propagated in air with power amplified by an antenna gain in an antenna, and the propagated signal may reach a receiving terminal or base station with power reduced by an attenuation level corresponding to the frequency of the signal in air. However, when the base station transmits a signal using a mmWave band (that is, 60 GHz), as illustrated in FIG. 2, the signal may face high radio-wave attenuation in air and may reach a receiving base station or terminal with low power, thus not achieving a high data transmission rate. Therefore, in data transmission and reception using a mmWave band, it is required to increase an antenna gain in order to compensate for a high radio-wave attenuation level.

Figure 3:
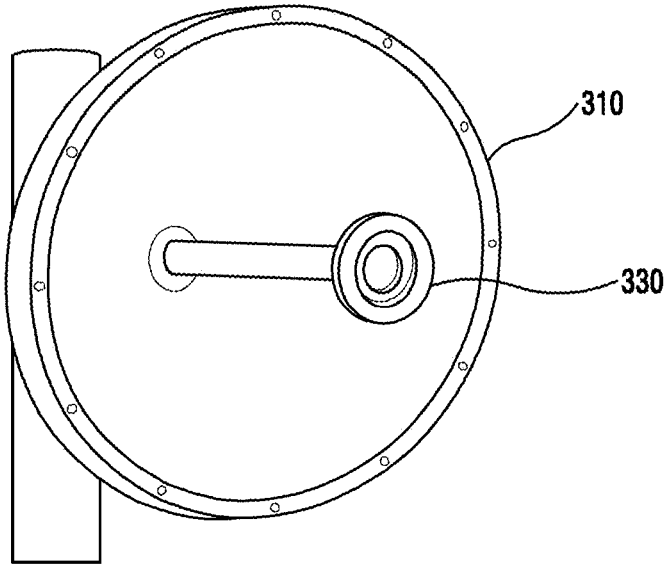
FIG. 3 illustrates an example parabolic antenna according to an exemplary embodiment of the present disclosure.

FIG. 3 illustrates an example parabolic antenna according to an exemplary embodiment of the present disclosure.

The parabolic antenna includes a reflector 310 and an antenna 330. The reflector 310 has a parabolic shape and may reflect incident radio waves. As the reflector 310 has a parabolic shape, incident radio waves upon the parabolic antenna may be reflected to point to a focal point of the reflector 310, that is, the focus of a parabola. Further, radio waves radiated from the position of a focal point of the parabolic antenna are reflected by the reflector 310, thus being radiated parallel with the axis of the antenna (the axis of the parabola).

The antenna 330 may radiate or receive radio waves. A portion of the antenna 330 that radiates or receives radio waves may be positioned at the focal point of the reflector 310. Thus, the parabolic antenna may steer radio waves to radiate in a specified direction or may steer received radio waves to point to one spot. Accordingly, the parabolic antenna may have a high antenna gain. For example, a parabolic antenna having a reflector 310 with a diameter of 30 cm to 40 cm may have an antenna gain of 40 decibels (dB).

As described above, the parabolic antenna has a high antenna gain and thus may efficiently compensate for high radio-wave attenuation that occurs in air even in data transmission and reception using a mmWave band. However, the parabolic antenna may transmit and receive radio waves only in a specified direction and may have difficulty in transmitting and receiving radio waves in a direction other than the specified direction. That is, the parabolic antenna may not facilitate a point-to-multi-point access for signal transmission and reception with devices located in different directions. The parabolic antenna has narrow coverage to transmit a beam with a high gain.

Figure 4A:
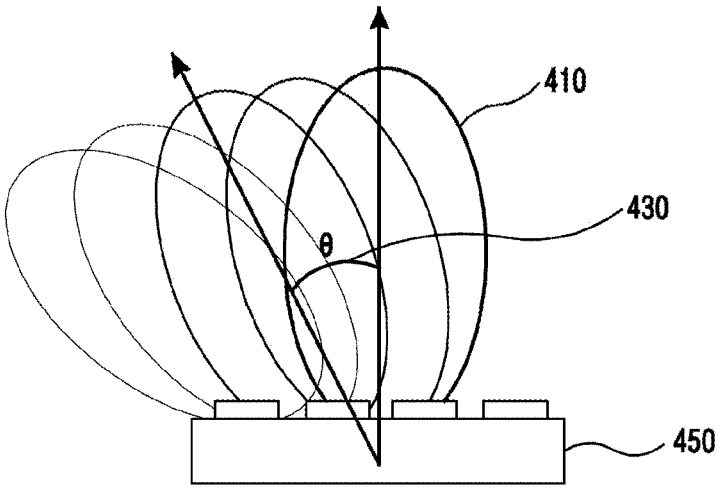
FIGS. 4A and 4B illustrate an example beam steerable phased array antenna according to an exemplary embodiment of the present disclosure.
Figure 4B:
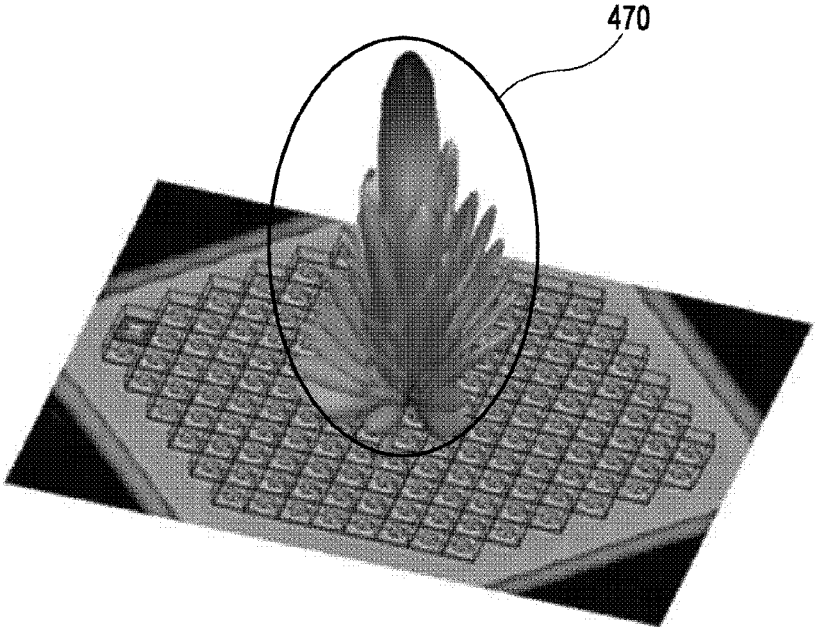

FIGS. 4A and 4B illustrate an example beam steerable phased array antenna according to an exemplary embodiment of the present disclosure.

Unlike a parabolic antenna that transmits a beam in a specified direction, a phased array antenna is provided as an example of an antenna that steers and transmits a beam in different directions in the present embodiment. One phased array antenna may be formed in an array of a plurality of antenna elements. Each of the antenna elements has a corresponding phase shifter. A signal to be transmitted from the antenna may be divided into a plurality of individual in-phase sub-signals, each of which is phase-shifted via each phase shifter. The phase-shifted signals may be transmitted by the antenna elements corresponding to the respective phase shifters. The shape of the phase shifter may be changed by an electrical signal, and the phase shifter with a changed shape may change the path length of a sub-signal transmitted from each antenna element or the propagation constant of a transmitting medium, thereby shifting the phase of each signal. Sub-signals transmitted from the respective antenna elements form an entire beam transmitted from the phased array antenna. That is, the entire beam transmitted from the phased array antenna includes the phase-shifted sub-signals, and the direction of the entire beam may be determined by adjusting the phases of the respective sub-signals. Although each of the antenna elements has a fixed position in the phased array antenna, the phased array antenna changes the phases of the sub-signals using the phase shifters corresponding to the respective antenna elements, thereby steering the transmitted entire beam.

FIG. 4A illustrates the phased array antenna 450 and a beam 410 steered by the phased array antenna 450. In FIG. 4A, each ellipse denotes a beam 410 steered by the phased array antenna 450 in a specified direction. An angle 430 denotes the angle of a beam steered from a perpendicular direction to the antenna. The phased array antenna 450 may adjust the phases of the sub-signals transmitted from the respective antenna elements to change the angle 430 variously and may steer and transmit a beam in different directions. FIG. 4A illustrates that the beam 410 is steered to the left by an angle of 410 from the perpendicular direction to the phased array antenna. However, the beam-steered angle of 410 illustrated in FIG. 4A is provided for illustrative purposes, and the beam may be steered by different angles. Further, since the antenna elements may be set in plane array in the phased array antenna, the beam 410 transmitted from the antenna may be steered not only in a left-and-right direction but also in a back-and-forth direction.

FIG. 4B illustrates a radiation pattern of the phased array antenna 450. More specifically, FIG. 4B illustrates a radiation pattern in a case where the phased array antenna 450 steers a beam to transmit in the perpendicular direction to the phased array antenna 450. In FIG. 4B, various shapes of figures 470 on the phased array antenna 450 denote the power of beams radiated in different directions. In FIG. 4B, since the phased array antenna 450 steers a beam to transmit in the perpendicular direction, a beam emitted in the perpendicular direction has the highest power. However, the direction of a beam having the highest power may be changed variously according to the direction of a beam steered by the phased array antenna 450.

Figure 5A:
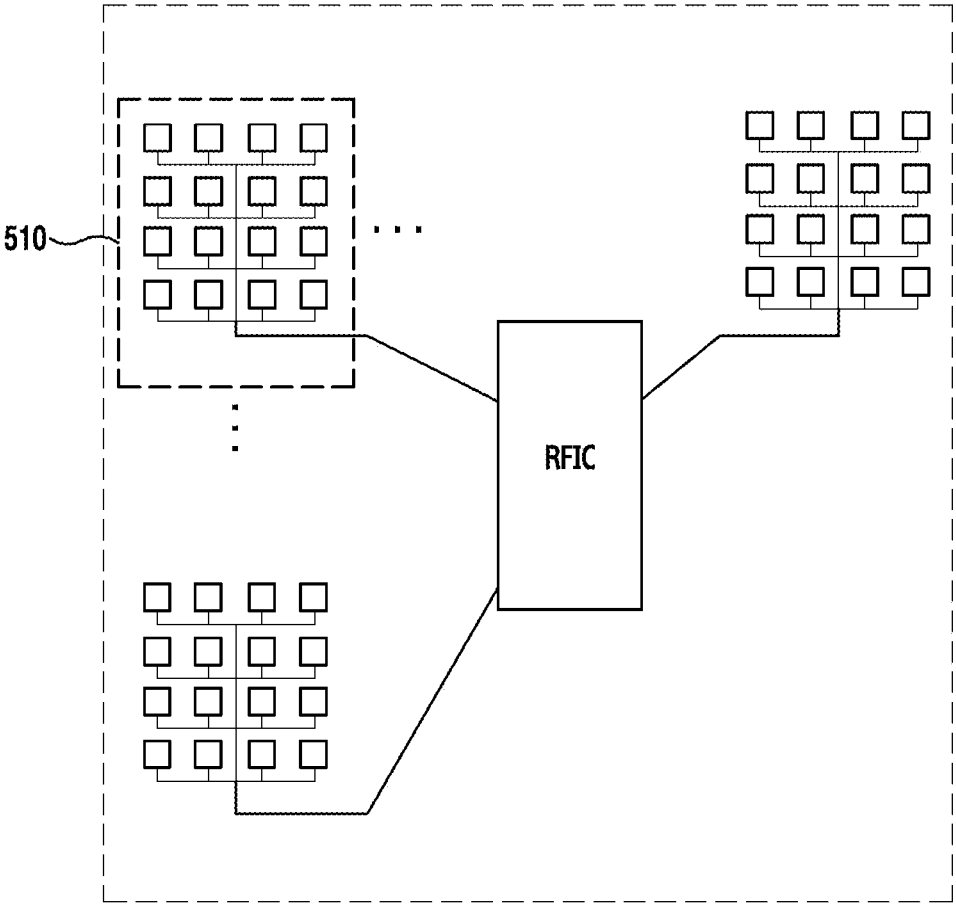
FIGS. 5A and 5B illustrate an example decrease in gain of a phased array antenna due to a printed circuit board (PCB) loss according to an exemplary embodiment of the present disclosure.
Figure 5B:
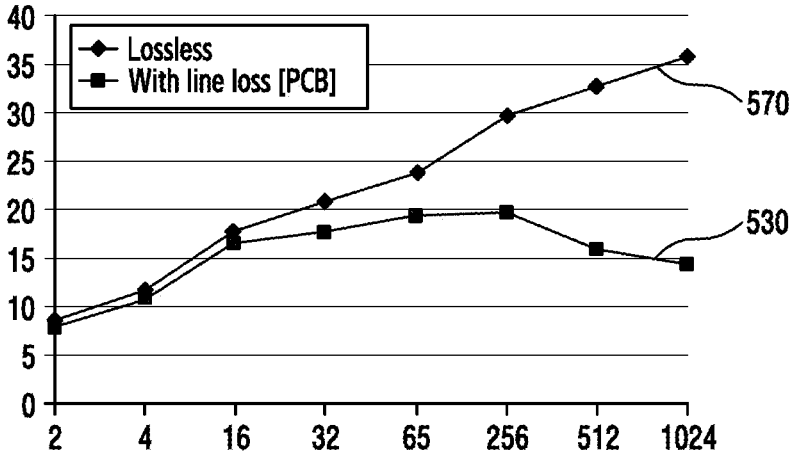

FIGS. 5A and 5B illustrate an example decrease in gain of a phased array antenna due to a printed circuit board (PCB) loss according to an exemplary embodiment of the present disclosure.

The phased array antenna may be formed in an array of a plurality of antenna elements. The antenna elements may be arrayed on a PCB to form the phased array antenna. As illustrated in FIG. 5A, the antenna elements may be connected via transmission lines on the PCB and may be connected to a radio frequency integrated circuit (RFIC) through transmission lines.

Generally, as the number of antenna elements forming a phased array antenna increases, the entire phased array antenna has a higher gain. Antenna gain may be defined, for example, as the rate at which the power of a signal transmitted by the antenna is amplified by the antenna. However, antenna gain may be defined variously. FIG. 5B is a graph illustrating a relationship between the number of antenna elements forming the phased array antenna and the gain of the entire phased array antenna. In FIG. 5B, the horizontal axis denotes the number of antenna elements forming the phased array antenna, and the vertical axis denotes the gain of the antenna expressed in decibel (dB). Referring to FIG. 5B, in an ideal case where no transmission line loss occurs, regardless of the number of antenna elements forming the phased array antenna, the gain of the entire phased array antenna increases with an increase in the number of antenna elements. However, in an actual case, loss, that is, PCB line loss, may occur when a signal travels through the transmission paths used in the PCB. As the number of antenna elements forming the phased array antenna increases, the length of transmission lines used for the PCB increases, and thus PCB line loss increases in the entire phased array antenna. Referring to FIG. 5B, due to PCB line loss, the gain of the antenna is smaller in the presence of PCB line loss 530 than in the ideal case 570. The antenna has the highest gain when the number of antenna elements forming the phased array antenna is 256. When the number of antenna elements exceeds 256, PCB line loss is significant as compared with an increase in antenna gain due to an increase in the number of antenna elements, causing a decrease in antenna gain. Referring to FIG. 5B, since the gain of the phased array antenna has the upper limit due to PCB line loss, it is required to enhance the antenna gain, besides increasing the number of antenna elements forming the phased array antenna.

Figure 6A:
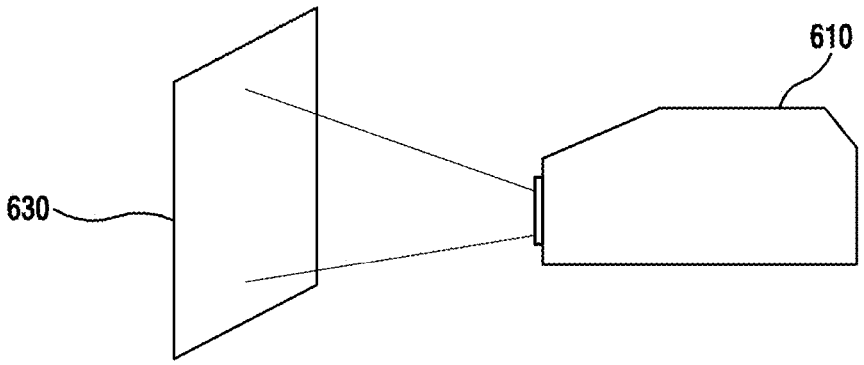
FIGS. 6A and 6B illustrate an example increase in antenna gain in a case of using a lens in a backhaul device according to an exemplary embodiment of the present disclosure.
Figure 6B:
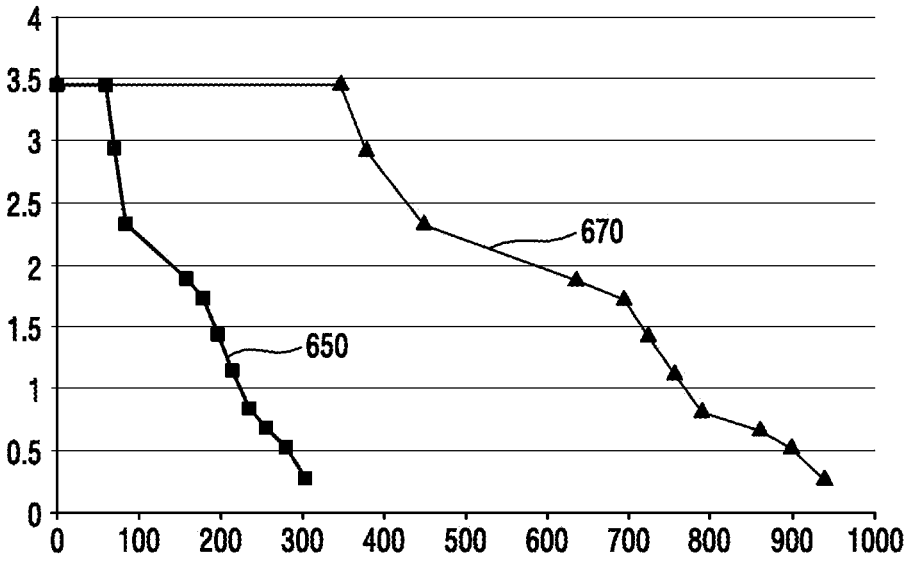

FIGS. 6A and 6B illustrate an example increase in antenna gain in a case of using a lens in a backhaul device according to an exemplary embodiment of the present disclosure.

FIG. 6A illustrates a backhaul device 610 and a lens 630. The backhaul device 610 and the lens 630 may be included, for example, in a base station 110. The backhaul device 610 may transmit or receive a beam and may include at least one antenna to this end. The at least one antenna may be, for example, a phased array antenna. The backhaul device 610 may transmit a beam radiated in all directions using the at least one antenna. Further, the backhaul device 610 may steer a beam using the phased array antenna and may transmit a beam in a specified direction.

The lens 630 may concentrate an incident beam upon the lens 630. That is, when a beam is incident upon the lens 630, the lens 630 may prevent the beam from spreading in different directions. The lens 630 may be positioned in front of the backhaul device 610. Although FIG. 6A illustrates the lens 630 in a plane form, which is merely an example, the lens 630 may have different forms. When a beam is incident upon the lens 630, the lens 630 may concentrate the beam to increase the received power of the beam in a specified direction. That is, the lens 630 may compensate for a reduced antenna gain by PCB line loss.

FIG. 6B is a graph comparing the antenna gain in a case of using no lens with a case of using the lens. In the graph, the horizontal axis denotes the distance between a transmitting end and a receiving end, and the vertical axis denotes a data transmission rate. The distance and the data transmission rate may be expressed in meters and gigabytes per second (Gb/s), respectively. A curve 650 denotes the data transmission rate according to the distance between the transmitting end and the receiving end in the case of using no lens, and a curve 670 denotes the data transmission rate according to the distance between the transmitting end and the receiving end in the case of using the lens. According to the curves 650 and 670, at the same data transmission rate, the distance between the transmitting end and the receiving end is longer in the case of using the lens. That is, in the case of using the lens, the same data transmission rate may be achieved even in a longer distance between the transmitting end and the receiving end, and the antenna gain is higher.

Figure 7A:
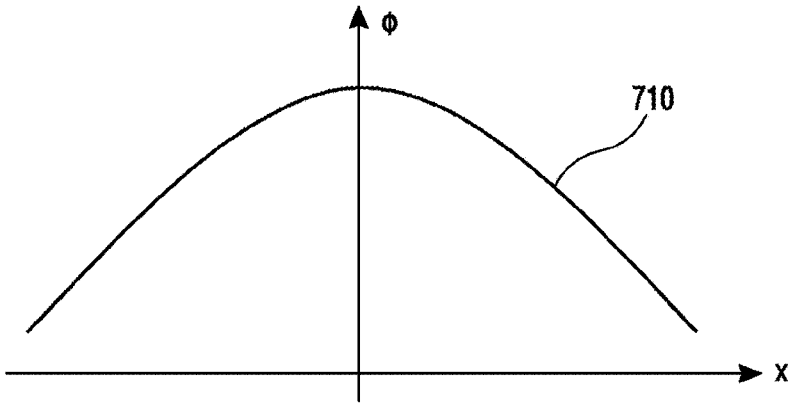
FIGS. 7A and 7B illustrate an example phase profile of a lens with a single focal point according to an exemplary embodiment of the present disclosure.
Figure 7B:
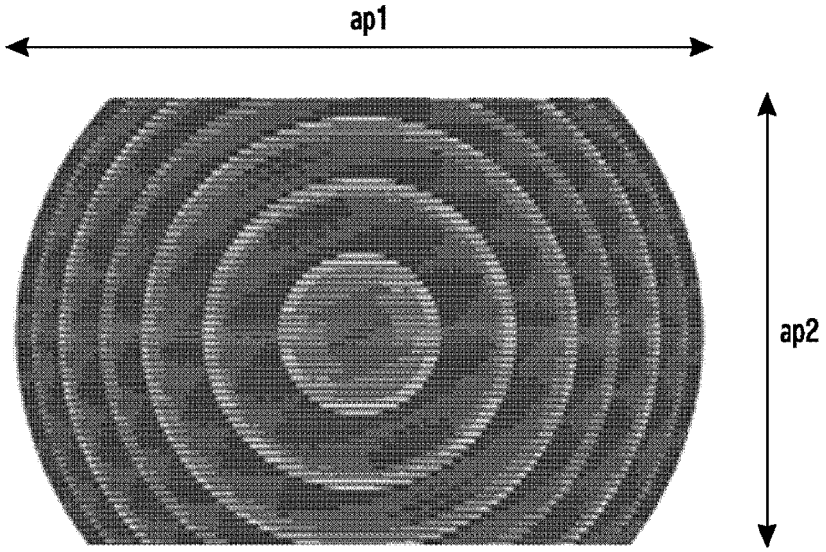

FIGS. 7A and 7B illustrate an example phase profile of a lens with a single focal point according to an exemplary embodiment of the present disclosure.

Generally, a beam transmitted from an antenna has a curved wave front. A wave front refers to a surface passing through points having the same phase in radio-wave components included in the beam transmitted from the antenna.

Each radio-wave component included in the beam transmitted from the antenna propagates in a direction perpendicular to the wave front. Since the wave front of the beam transmitted from the antenna has a curved-surface shape, the radio-wave components included in the beam may spread in different directions perpendicular to the wave front. Even though a phased array antenna transmits a beam in a specified direction, since the beam has a curved wave front, some radio-wave components may spread in different directions. A lens may be used to prevent radio-wave components of a beam from spreading in different directions and to direct the beam in a specified direction, thus increasing the power of the received beam. That is, when the antenna transmits a beam through the lens, it is possible to steer the beam transmitted in a different direction to point in the specified direction.

Specifically, the lens may compensate the phases of radio-wave components incident to different areas of the lens with different values, thereby steering the beam passing through the lens to point in the specified direction. When the antenna radiates the beam through the lens, since the beam radiated from the antenna has a curved wave front, radio-wave components incident to the different areas of the lens at a specific time have different phases. The lens may compensate the phases of the radio-wave components incident to the different areas of the lens with different values so that the beam passing through the lens has a plane wave front. That is, the lens may compensate the phase values of the radio-wave components incident to the different areas of the lens so that the beam passing through the lens becomes a plane wave. Since radio-wave components of a plane wave propagate in a direction perpendicular to a wave front that is plane, and thus propagates in the same direction. Therefore, the lens allows the beam radiated from the antenna to become a plane wave, steering the radio-wave components forming the beam in the same direction, without spreading in different directions, thereby concentrating the beam in the specified direction.

FIG. 7A is a graph illustrating the compensated phase of an incident radio-wave component according to the distance of each area of the lens from the center of the lens. According to the phase profile of the lens of the present embodiment, the phase of a radio-wave component at the center of the lens is compensated with the greatest value, while the phase of a radio-wave component at an area more distant from the center of the lens is compensated with a smaller value. That is, the profile of the lens of the present embodiment has the local maximum value at the center of the lens. Hereinafter, the graph illustrated in FIG. 7A is defined as a 'phase profile' according to the present disclosure. FIG. 7A illustrates the phase profile of the lens according to the one-dimensional distance of each area of the lens from the center of the lens. However, since the lens may have a three-dimensional shape, the phase profile of the lens may be represented in various forms. For example, as in FIG. 7B, the phase profile may be represented in two dimensions. FIG. 7B two-dimensionally represents the phase profile of the lens illustrated in FIG. 7A. In FIG. 7B, the boundary of each concentric circle indicates a line connecting positions in the lens, at which phases having the same value are compensated for. Referring to FIG. 7B, the phase profile of the lens that is circular shows that phase is compensated with the greatest value at the center of the lens, while phase is compensated with a smaller value at an area more distant from the center of the lens.

In one exemplary embodiment, it is assumed that a beam from a phased array antenna is steered to be transmitted to the center of a lens having the phase profile illustrated in FIG. 7A. The phase of a radio-wave component reaching each area of the lens at a specific time is the slowest at the center of the lens and is faster at an area more distant from the center of the lens. In this case, the lens may compensate the phase of a radio-wave component reaching the center of the lens with a great value and may compensate the phase of a radio-wave component reaching an area distant from the center of the lens with a small value, thereby allowing the beam passing through the lens to have a plane wave front. Thus, when the beam steered to be transmitted from the antenna to the center of the lens passes through the lens having the phase profile illustrated in FIG. 7A, the beam may form a plane wave to point in a specified direction. Here, the wave front of the plane wave may be perpendicular to a straight line connecting the antenna and the center of the lens. In another exemplary embodiment, it is assumed that a beam from a phased array antenna is steered to be transmitted to an area of a lens other than the center of the lens having the phase profile illustrated in FIG. 7A. The area to which the beam is steered is not the center of the lens, in which the phase profile of the lens does not have local maximum value. In this case, the phase of a radio-wave component reaching each area of the lens at a specific time is the slowest at the area of the lens to which the beam is steered and is faster at an area more distant from the area of the lens to which the beam is steered. Thus, the lens may compensate, with a great value, the phase of a radio-wave component reaching the area of the lens to which the beam is steered and may compensate, with a small value, the phase of a radio-wave component reaching an area that is distant from the area of the lens to which the beam is steered, thereby allowing the beam passing through the lens to have a plane wave front. However, since the lens has the phase profile as illustrated in FIG. 7A, compensating phase with the greatest value does not occur at the area of the lens to which the beam is steered. That is, the lens having the phase profile as in FIG. 7A may concentrate a beam transmitted to the center of the lens at which the phase profile has the local maximum value.

As described above, when the phased array antenna steers a beam to be transmitted to an area of the lens in which the profile of the lens has the local maximum value, the beam passing through the lens may form a plane wave to point in a direction toward a straight line connecting the antenna and the area of the lens. That is, the area of the lens at which the profile of the lens has the local maximum value may correspond to a focal point to which the beam points. Hereinafter, the area of the lens at which the profile of the lens has the local maximum value and the focal point of the lens may be used to express the same meaning in the present disclosure.

Figure 8A:
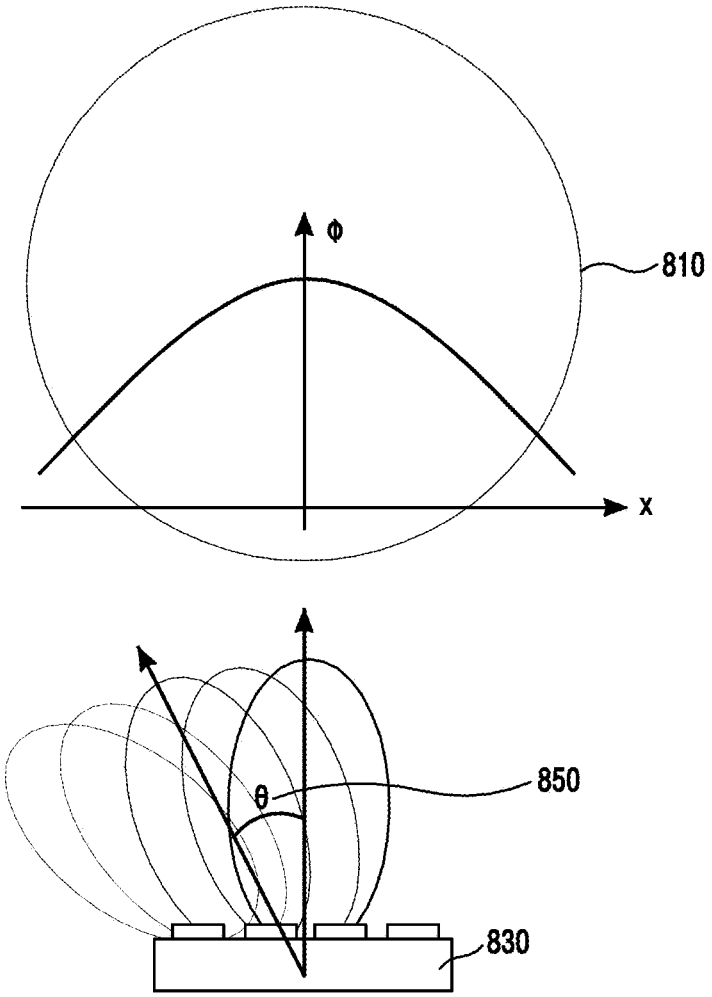
FIGS. 8A and 8B illustrate an example antenna gain based on the angle of a steered beam in the transmission of the beam through a lens with a monotonic phase profile according to exemplary embodiment of the present disclosure.
Figure 8B:
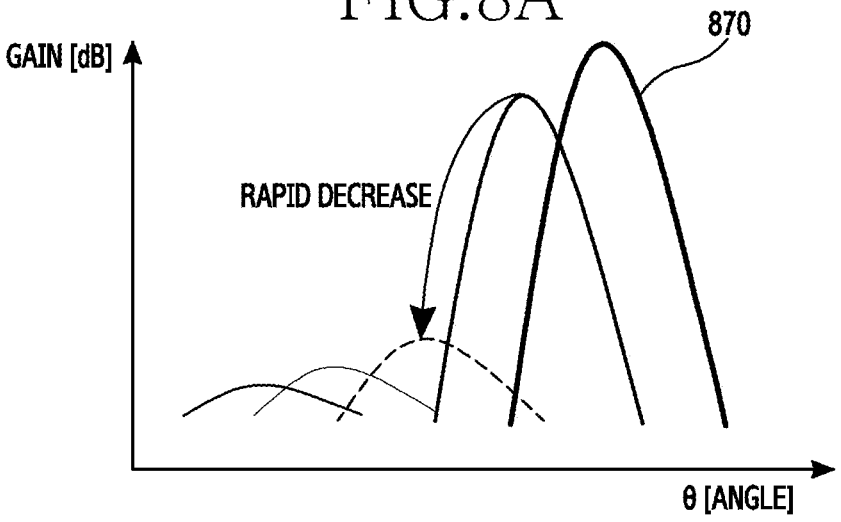

FIGS. 8A and 8B illustrate an example antenna gain based on the angle of a steered beam in the transmission of the beam through a lens with a monotonic phase profile according to an exemplary embodiment of the present disclosure. In the present disclosure, a 'lens with a monotonic phase profile' refers to a lens with a phase profile having one local maximum value hereinafter.

FIG. 8A illustrates a phased array antenna 830 and a lens 810 positioned in front of the phased array antenna 830. The lens 810 may compensate the phases of radio-wave components incident to different areas of the lens 810, thereby steering the beam passing through the lens to point in a specified direction. The phase profile illustrated in the lens 810 denotes the phase of a radio-wave component compensated at the position of the corresponding area of the lens.

According to the phase profile, the lens 810 compensates the phase of a radio-wave component at the center of the lens with the greatest value and compensates the phase of a radio-wave component at an area more distant from the center of the lens with a smaller value. That is, a focal point of the lens 810 may be positioned at the center of the lens 810. The phase profile of the lens 810 may be the same as the phase profile illustrated in FIG. 7B. The lens 810 is shown to have a circular shape, which is for illustrative purposes. The lens 810 may have various shapes.

The phased array antenna 830 may transmit a steerable beam. The phased array antenna 830 may adjust the phase of a sub-signal transmitted from each antenna element forming the phased array antenna 830, thereby steering the entire beam transmitted from the phased array antenna 830. The phased array antenna 830 may steer the transmitted beam in different directions. For example, the phased array antenna 830 may steer the beam to be transmitted to the center of the lens 810 or may steer the beam to be transmitted to an area other than the center of the lens 810. The present embodiment shows that when the phased array antenna 830 steers the beam to be transmitted in a direction perpendicular to the phased array antenna 830, the transmitted beam passes through the center of the lens 810. Further, an angle 850 denotes the extent to which the transmitted beam is steered from the direction perpendicular to the phased array antenna 830.

When the phased array antenna 830 transmits the beam in the direction perpendicular to the phased array antenna 830, the transmitted beam passes through the center of the lens 810. That is, the beam transmitted from the phased array antenna 830 passes through the focal point of the lens 810. As the phase profile of the lens 810 has the local maximum value at the focal point of the lens 810, the phase of each radio-wave component forming the beam transmitted from the phased array antenna 830 is properly compensated, allowing the beam passing through the lens to become a plane wave. When the phased array antenna 830 transmits the beam in the direction perpendicular to the phased array antenna 830, the beam may be concentrated by the lens, and a high antenna gain may be obtained.

However, when the phased array antenna 830 transmits a beam by changing the angle 850, the beam transmitted from the phased array antenna 830 does not pass through the focal point of the lens and thus does not become a plane wave, and only a relatively low gain may be obtained. FIG. 8B illustrates an antenna gain according to the beam steering angle 850. In FIG. 8B, the horizontal axis denotes the beam steering angle, and the vertical axis denotes the antenna gain expressed in decibels. A curve 870 denotes the antenna gain obtained when the angle 850 is set to steer the beam from the phased array antenna 830 in the perpendicular direction. Referring to FIG. 8B, as the angle 850 is changed substantially, the antenna gain rapidly decreases.

According to the foregoing embodiments, when the phased array antenna 830 transmits a beam towards the focal point of the lens 810, a high gain may be achieved. However, when the phased array antenna 830 transmits a beam towards an area of the lens 810 other than the focal point of the lens 810, a relatively low gain may be obtained. That is, when the phased array antenna 830 obtains an antenna gain high enough to compensate for transmission line loss occurring in the PCB by using the lens 810, coverage to transmit data with the high antenna gain is narrow. Therefore, the present disclosure provides a method for not only obtaining a high antenna gain in a specified direction by using a lens but also increasing a range of obtaining a high antenna gain.

Figure 9A:
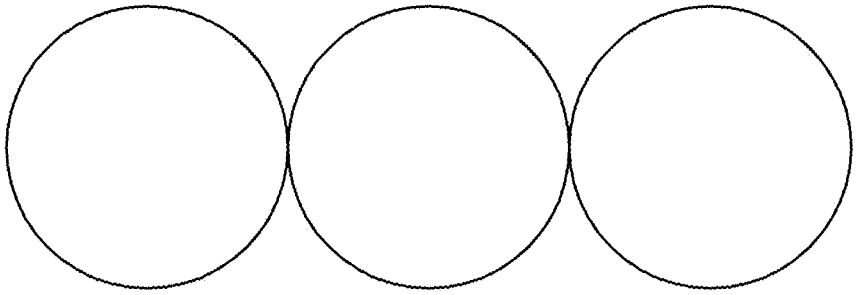
FIGS. 9A and 9B illustrate an example phase profile of a lens with a plurality of focal points according to an exemplary embodiment of the present disclosure.
Figure 9B:
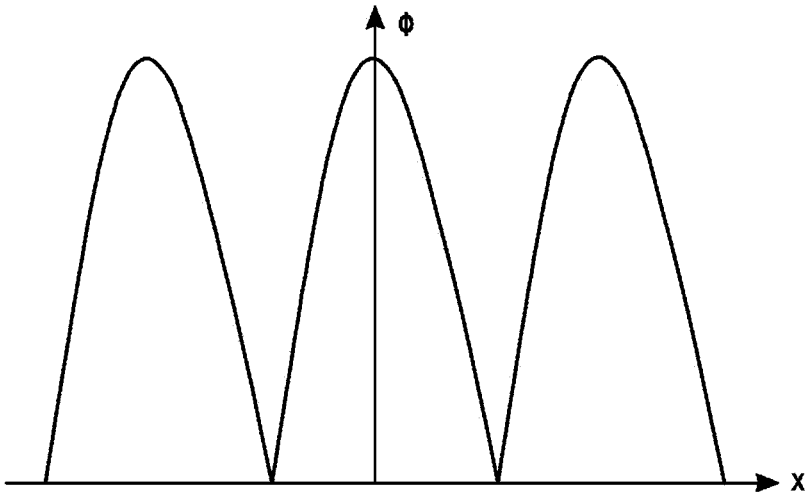

FIGS. 9A and 9B illustrate an example phase profile of a lens with a plurality of focal points according to an exemplary embodiment of the present disclosure.

When a phased array antenna steers a beam to be transmitted towards a focal point of the lens, the transmitted beam passes through the lens to form a plane wave, thus obtaining a high antenna gain. However, when the phased array antenna steers a beam to be transmitted towards an area of the lens distant from the focal point of the lens, a relatively low antenna gain may be obtained. That is, when the phased array antenna transmits a beam through a lens with a single focal point, it is impossible to obtain a high antenna gain in different directions. However, with a lens having a plurality of focal points, even though the phased array antenna steers a beam to be transmitted in different directions towards the plurality of focal points of the lens, a high antenna gain may be obtained. The lens with the plurality of focal points may be formed, for example, by disposing sub-lenses each having one focal point to be adjacent to each other as illustrated in FIG. 9A. Each sub-lens may have the same phase profile as illustrated in FIG. 7A. FIG. 9A shows that each sub-lens has a circular plane shape, which is merely an example. Each sub-lens may have various shapes. Further, although FIG. 9A illustrates three neighboring sub-lenses, the number of neighboring sub-lenses may be greater or less than three.

FIG. 9B illustrates the phase profile of the lens formed as in FIG. 9A. In FIG. 9B, the horizontal axis denotes horizontal distance from the lens, and the vertical axis denotes the phase of a radio-wave component compensated by the lens at each distance. The phase profile of each sub-lens forming the lens has one local maximum value as illustrated in FIG. 7A. Thus, the phase profile of the lens including the three sub-lenses may have three local maximum values as in FIG. 9B, and accordingly the lens may have three focal points. When the lens has the phase profile as illustrated in FIG. 9B, the phased array antenna may obtain a high antenna gain not only when transmitting a beam towards the center of the lens at which a focal point of the lens is positioned but also when transmitting a beam in a different direction where another focal point of the lens is positioned. That is, the phases of radio-wave components forming a beam transmitted in a direction that is different, not towards the center of the lens, are properly compensated so that the beam passes through to form a plane wave, thereby allowing the beam transmitted in the different direction to have a high antenna gain, as well as the beam transmitted towards the center of the lens.

Figure 10A:
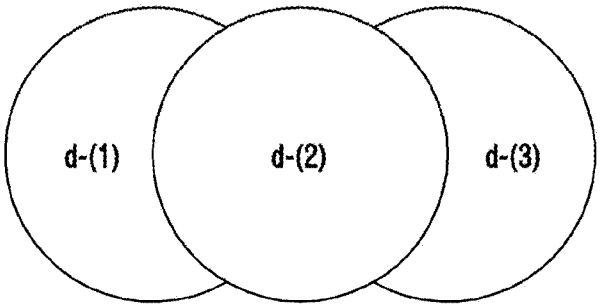
FIGS. 10A to 10C illustrate an example lens with a plurality of focal points and a phase profile thereof according to another exemplary embodiment of the present disclosure.
Figure 10B:
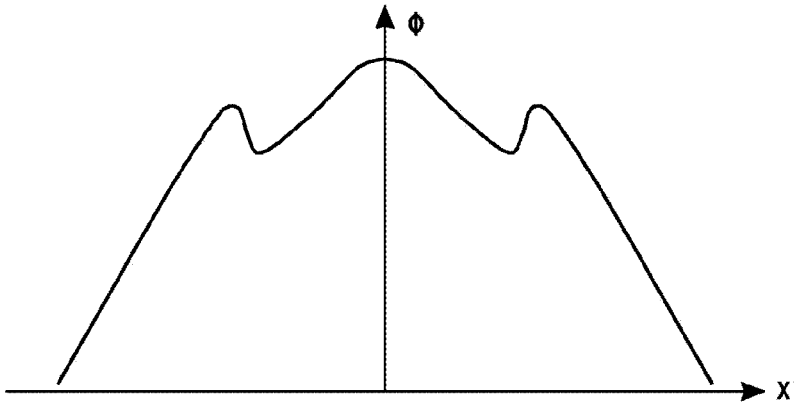
Figure 10C:
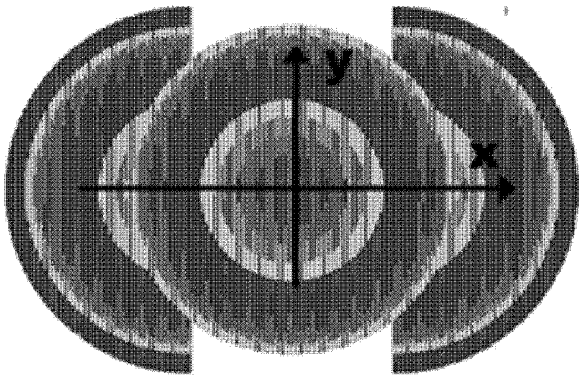

FIGS. 10A to 10C illustrate an example lens with a plurality of focal points and a phase profile thereof according to another exemplary embodiment of the present disclosure.

A lens with a plurality of focal points may be formed, for another example, by disposing sub-lenses each having one focal point to be adjacent to each other as illustrated in FIG. 10A. Referring to FIG. 10A, among the sub-lenses forming the lens, a middle sub-lens has a circular plane shape, and sub-lenses disposed on both sides of the middle sub-lens have a segmented-circular plane shape. Hereinafter, for the convenience of description, the middle sub-lens is defined as a first sub-lens, and the sub-lenses disposed on both sides of the middle sub-lens are defined as a second sub-lens and a third sub-lens, respectively, from the left. In the present embodiment, the second sub-lens and the third sub-lens may include part of the first sub-lens.

The first sub-lens may have, for example, the same phase profile as illustrated in FIG. 7A. Since the second sub-lens and the third sub-lens include part of the first sub-lens, the phase profiles of the second sub-lens and the third sub-lens may include part of the phase profile of the first sub-lens. Although FIG. 10A illustrates three neighboring sub-lenses, the number of neighboring sub-lenses may be greater or less than three. For example, another sub-lens with the same shape as the second sub-lens may be adjacent on the left side of the second sub-lens, and another sub-lens with the same shape as the third sub-lens may be adjacent on the right side of the third sub-lens. The first sub-lens, the second sub-lens, and the third sub-lens may be present on the same plane.

FIG. 10B illustrates the phase profile of the lens formed as in FIG. 10A. In FIG. 10B, the horizontal axis denotes distance from the center of the first sub-lens, and the vertical axis denotes the phase of a radio-wave component compensated by the lens at each distance. The phase profiles of the first sub-lens, the second sub-lens, and the third sub-lens forming the lens each have one local maximum value. Thus, the phase profile of the lens including the three sub-lenses may have three local maximum values as in FIG. 10B, and thus the lens may have three focal points. When the lens has the phase profile as illustrated in FIG. 10B, the phased array antenna may obtain a high antenna gain not only when transmitting a beam towards the center of the lens at which a focal point of the lens is positioned but also when transmitting a beam in a different direction where another focal point of the lens is positioned. That is, the phases of radio-wave components forming a beam transmitted in a direction that is different, not towards the center of the lens, are properly compensated so that the beam passes through the lens to form a plane wave, thereby allowing the beam transmitted in the different direction to have a high antenna gain, as well as the beam transmitted towards the center of the lens. Comparing with FIG. 9B, since the distance of a focal point of the lens, other than the focal point at the center of the lens, from the center of the lens is different, the direction of a transmitted beam to achieve a high antenna gain may be different. That is, a range of obtaining a high antenna gain may be different.

FIG. 10C two-dimensionally represents the phase profile of the lens having the phase profile illustrated in FIG. 10B. In FIG. 10C, the boundary of each circle or segmented circle indicates a line connecting positions in the lens, at which phases having the same value are compensated for. Referring to FIG. 10C, the phase profile of the lens shows that phase is compensated with the greatest value at the centers of the first sub-lens, the second sub-lens, and the third sub-lens, while phase is compensated with a smaller value at an area more distant from the centers.

Figure 11A:
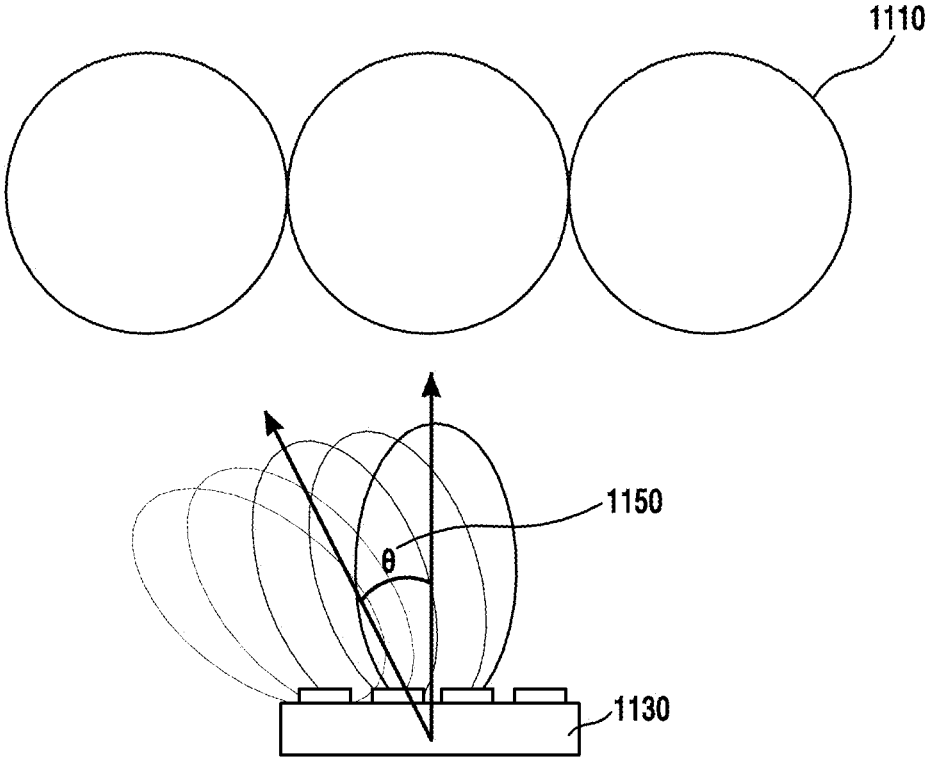
FIGS. 11A and 11B illustrate an example antenna gain according to the angle of a steered beam in the transmission of the beam through a lens with a non-monotonic phase profile according to an exemplary embodiment of the present disclosure.
Figure 11B:
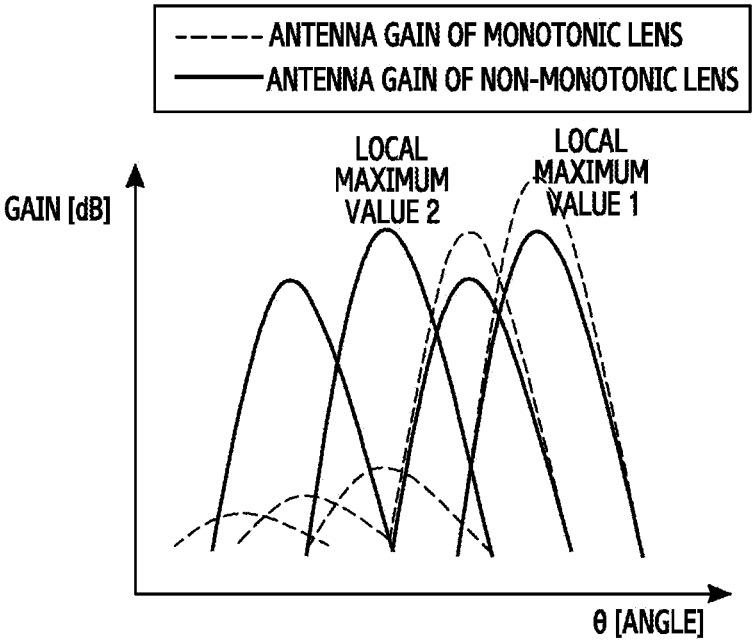

FIGS. 11A and 11B illustrate an example antenna gain based on the angle of a steered beam in the transmission of the beam through a lens with a non-monotonic phase profile according to an exemplary embodiment of the present disclosure. In the present disclosure, a 'lens with a non-monotonic phase profile' refers to a lens with a phase profile having a plurality of local maximum values hereinafter.

FIG. 11A illustrates a phased array antenna 1130 and a lens 1110 positioned in front of the phased array antenna 1130. In the present embodiment, the lens 1110 is the same as the lens illustrated in FIG. 9A. That is, the lens 1110 may be formed by disposing circular plane sub-lenses each having one focal point to be adjacent to each other. The lens 1110 has the same phase profile as illustrated in FIG. 9B. According to the phase profile, the lens 1110 compensates the phase of a radio-wave component at the center of each sub-lens with the greatest value and compensates the phase of a radio-wave component at an area more distant from the center with a smaller value. That is, the lens 1110 has three focal points, each of which is positioned at the center of each sub-lens forming the lens 1110. Hereinafter, for the convenience of description, the focal point of a middle sub-lens of the lens 1110 is defined as a first focal point, the focal point of a sub-lens positioned on the left side of the sub-lens having the first focal point is defined as a second focal point, and the focal point of a sub-lens positioned on the right side of the sub-lens having the first focal point is defined as a third focal point.

The phased array antenna 1130 may transmit a steerable beam. The present embodiment shows that when the phased array antenna 1130 steers the beam to be transmitted in a direction perpendicular to the phased array antenna 1130, the transmitted beam passes through the center of the middle sub-lens of the lens 1110, that is, the center of the lens 1110. Further, an angle 1150 denotes the extent to which the transmitted beam is steered from the direction perpendicular to the phased array antenna 1130.

When the phased array antenna 1130 transmits the beam in the direction perpendicular to the phased array antenna 1130, the transmitted beam passes through the center of the lens 1110. That is, the beam transmitted from the phased array antenna 1130 passes through the first focal point. As the phase profile of the lens 1110 has the local maximum value at the first focal point, the phase of each radio-wave component forming the beam transmitted from the phased array antenna 1130 is properly compensated, allowing the beam passing through the lens to become a plane wave. When the phased array antenna 1130 transmits the beam in the direction perpendicular to the phased array antenna 1130, the beam may be concentrated by the lens, and a high antenna gain may be obtained. Further, unlike in FIGS. 9A and 9B, even when the phased array antenna 1130 transmits a beam by changing the angle 1150, the beam passing through the lens may be concentrated due to the second focal point and the third focal point, and a high antenna gain may be obtained.

FIG. 11B illustrates an antenna gain according to the beam steering angle 1150. In FIG. 11B, the horizontal axis denotes the beam steering angle 1150, and the vertical axis denotes the antenna gain expressed in decibels according to the beam steering angle 1150. In FIG. 11B, graphs indicated by solid lines illustrate antenna gains according to a beam steering angle 1150 in the transmission of a beam using the lens 1110, while graphs indicated by dotted lines illustrate antenna gains according to a beam steering angle 1150 in the transmission of a beam using a lens having a monotonic phase profile, for example, the lens 810. The rightmost parabolas among the graphs illustrate antenna gains obtained when the phased array antenna steers a beam in the direction perpendicular to the phased array antenna. Referring to FIG. 11B, in the transmission of a beam using the lens 1110, even though changing the beam steering angle 1150, the phased array antenna 1130 may achieve a relatively high gain due to the second focal point or third focal point positioned in areas other than the center of the lens 1110. However, the phased array antenna 1130 transmits a beam using the lens 810, the antenna gain rapidly decreases according to the changing angle 1150 as a beam steering direction deviates from the single focal point of the lens 810.

Figure 12A:
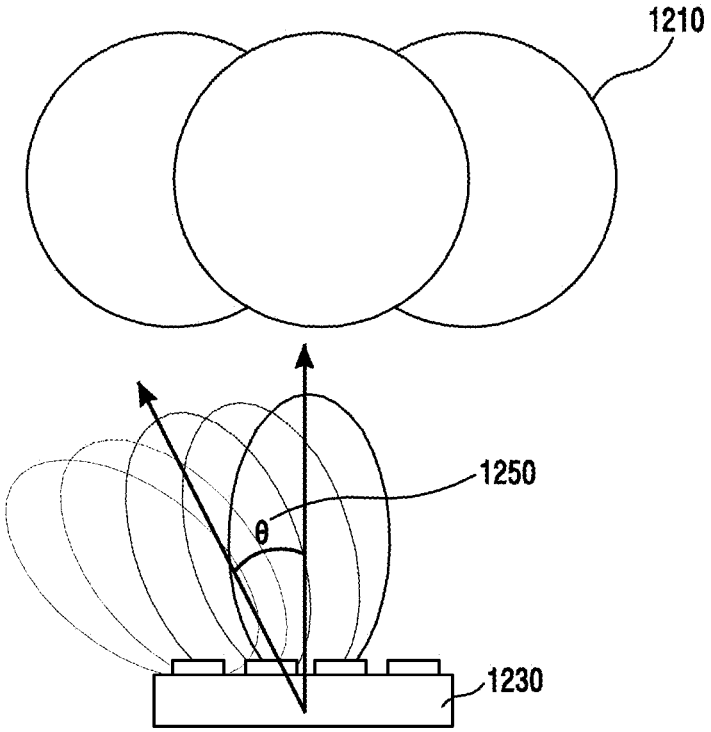
FIGS. 12A and 12B illustrate an example antenna gain according to the angle of a steered beam in the transmission of the beam through a lens with a non-monotonic phase profile according to another exemplary embodiment of the present disclosure.
Figure 12B:
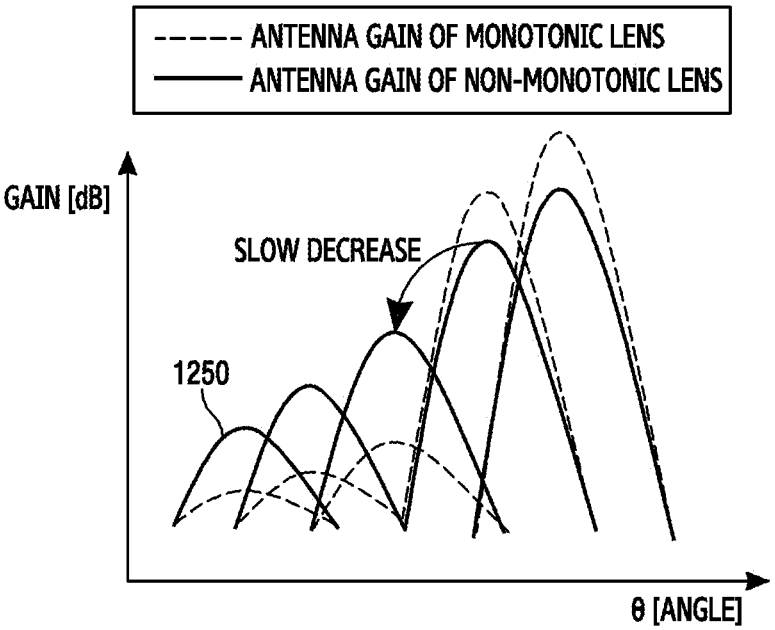

FIGS. 12A and 12B illustrate an example antenna gain based on the angle of a steered beam in the transmission of the beam through a lens with a non-monotonic phase profile according to another exemplary embodiment of the present disclosure.

FIG. 12A illustrates a phased array antenna 1230 and a lens 1210 positioned in front of the phased array antenna 1230. In the present embodiment, the lens 1210 is the same as the lens illustrated in FIG. 10A. That is, the lens 1210 may include a first sub-lens, a second sub-lens, and a third sub-lens. The lens 1210 has the same phase profile as illustrated in FIG. 10B. According to the phase profile, the lens 1210 compensates the phase of a radio-wave component at the center of each sub-lens with the greatest value and compensates the phase of a radio-wave component at an area more distant from the center with a smaller value. That is, the lens 1210 has three focal points, each of which is positioned at the center of each sub-lens forming the lens 1210.

The phased array antenna 1230 may transmit a steerable beam. The present embodiment shows that when the phased array antenna 1230 steers the beam to be transmitted in a direction perpendicular to the phased array antenna 1230, the transmitted beam passes through the center of the first sub-lens. Further, an angle 1250 denotes the extent to which the transmitted beam is steered from the direction perpendicular to the phased array antenna 1230.

When the phased array antenna 1230 transmits the beam in the direction perpendicular to the phased array antenna 1230, the transmitted beam passes through the center of the first sub-lens. That is, the beam transmitted from the phased array antenna 1230 passes through one of the focal points of the lens 1210. As the phase profile of the lens 1210 has the local maximum value at the center of the first sub-lens, the phase of each radio-wave component forming the beam transmitted from the phased array antenna 1230 is properly compensated, allowing the beam passing through the lens to become a plane wave. Accordingly, when the phased array antenna 1230 transmits the beam in the direction perpendicular to the phased array antenna 1230, the beam may be concentrated by the lens, and a high antenna gain may be obtained. Further, as in FIGS. 11A and 11B, even when the phased array antenna 1230 transmits a beam by changing the angle 1250, the beam passing through the lens may be concentrated due to the focal point of the second sub-lens and the focal point of the third sub-lens, and a high antenna gain may be obtained.

FIG. 12B illustrates an antenna gain according to the beam steering angle 1250. In FIG. 12B, graphs indicated by solid lines illustrate antenna gains according to a beam steering angle 1250 in the transmission of a beam using the lens 1210, while graphs indicated by dotted lines illustrate antenna gains according to a beam steering angle 1250 in the transmission of a beam using a lens having a monotonic phase profile, for example, the lens 810. The rightmost parabolas among the graphs illustrate antenna gains obtained when the phased array antenna steers a beam in the direction perpendicular to the phased array antenna 1230. Referring to FIG. 12B, in the transmission of a beam using the lens 1210, even though changing the beam steering angle 1250, the phased array antenna 1230 may achieve a relatively high gain due to the focal points positioned in areas other than the center of the first sub-lens. However, the phased array antenna 1230 transmits a beam using the lens 810, the antenna gain rapidly decreases according to the changing angle 1250 as a beam steering direction deviates from the single focal point of the lens 810. Comparing with FIG. 11B, due to differences in distance between focal points and phase profile between the lens 1110 and the lens 1210, the antenna gains according to a beam steering angle change with different aspects.

According to the foregoing embodiments, when a phased array antenna uses a lens with a plurality of focal points to transmit a beam, the phased array antenna has wider coverage to transmit data with a high antenna gain than when using a lens with a single focal point to transmit a beam.

Figure 13:
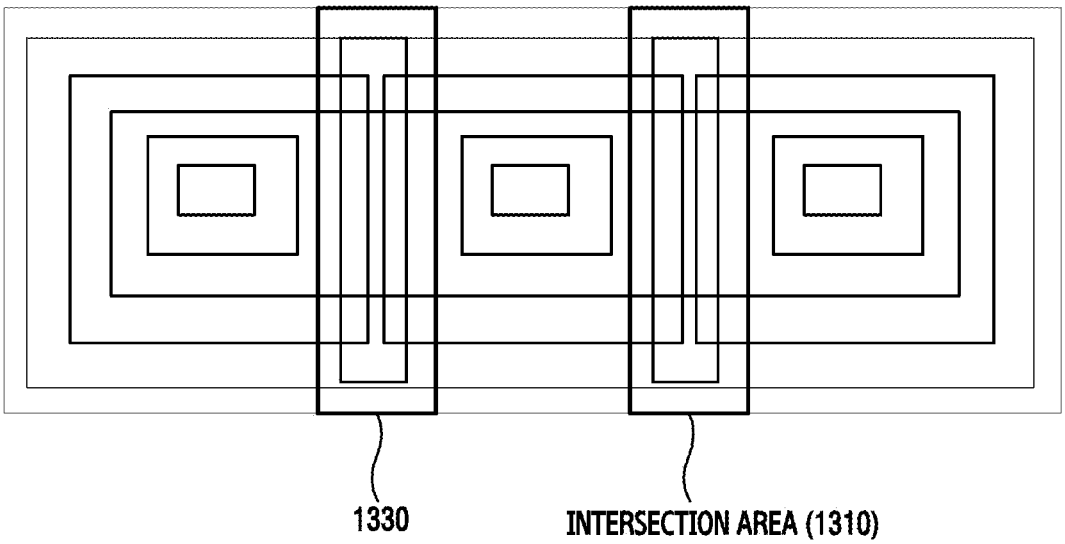
FIG. 13 and FIG. 14 illustrate an example intersection area between a plurality of sub-lenses forming a lens according to an exemplary embodiment of the present disclosure.
Figure 14:
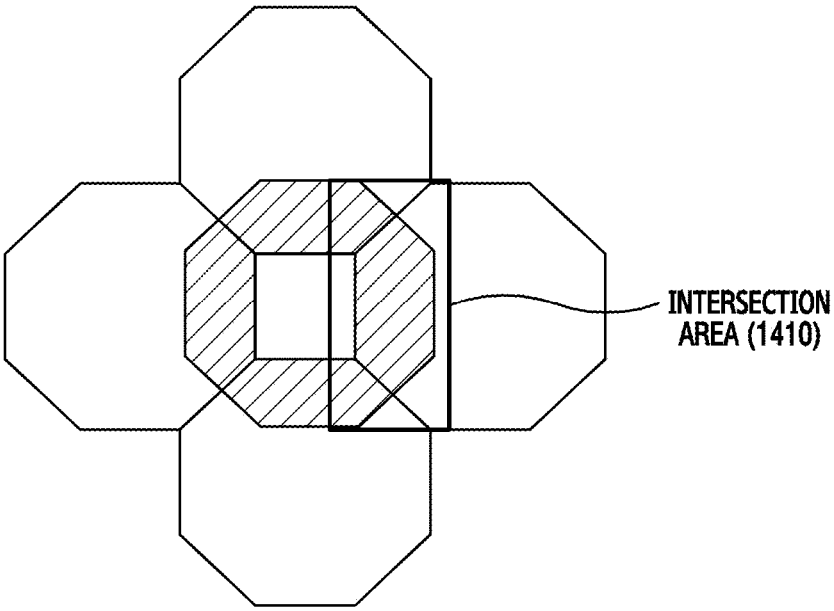

FIG. 13 and FIG. 14 illustrate an example intersection area between a plurality of sub-lenses forming a lens according to an exemplary embodiment of the present disclosure.

A lens with a plurality of focal points may be formed, for example, by disposing sub-lenses each having one focal point to be adjacent to each other. The lens may be formed by disposing three sub-lenses to be adjacent to each other as illustrated in FIG. 9A, and each sub-lens may be a plane lens that is complete circle-shaped. Further, the lens may be formed by disposing one complete circle-shaped plane lens to be adjacent to two segmented circle-shaped sub-lenses as illustrated in FIG. 10A. The lens illustrated in FIG. 10A may be considered as three complete circle-shaped sub-lenses intersecting. When sub-lenses intersect, the phase profiles of the respective sub-lenses may also intersect in an intersection area. The intersection area is processed, so that the entire lens may be positioned on the same plane. When the circular plane sub-lenses intersect as in FIG. 10A, intersection areas may have an oval-like shape. However, a sub-lens used to form a lens with a plurality of focal points may have various shapes. For example, a lens may be formed by disposing a plurality of rectangular sub-lenses to be adjacent to each other. Further, similar to FIG. 10A, rectangular sub-lenses intersect to form one lens. FIG. 13 illustrates an example in which rectangular sub-lenses intersect to form one lens. Although FIG. 13 illustrates three intersecting rectangular sub-lenses, the number of sub-lenses used to form a lens is not limited. Further, rectangular sub-lenses may intersect in a different manner from that in FIG. 13. When rectangular sub-lenses intersect as in FIG. 13, an intersection area 1310 has a rectangular shape. When the three rectangular sub-lenses intersect, there may be two intersection areas 1310 and 1330, and the entire lens may have a phase profile as in FIG. 13. Referring to FIG. 13, the phase profile has the local maximum value at the center of each rectangular sub-lens forming the lens, and the lens compensates the phase of a radio-wave component with a smaller value at an area more distant from the center of each rectangular sub-lens.

In the foregoing embodiments, a lens with a plurality of focal points may be formed of sub-lenses being arranged in a line or intersecting. In this case, the focal points of the lens with the plurality of focal points are in line. However, since the lens may be present in a three-dimensional space, the sub-lenses forming the lens may not be arranged in a line. Accordingly, the focal points of the lens with the plurality of focal points may be out of line. FIG. 14 illustrates an example in which a lens is formed by disposing sub-lenses to be positioned on the same plane in space, the focal points of the respective sub-lenses forming the lens not being arranged in a straight line. In FIG. 14, the lens may be formed of five octagonal plane sub-lenses. The phase profile of each sub-lens has the local maximum value, for example, at the center of the sub-lens forming the lens, and the lens may compensate the phase of a radio-wave component with a smaller value at an area more distant from the center of the sub-lens. Four octagonal sub-lenses may be cyclically arranged to be adjacent, and one additional sub-lens may be positioned at the center of the four sub-lenses to intersect with the four sub-lenses. When the octagonal sub-lenses intersect with each other, an intersection area 1410 may be hexagonal-shaped. When sub-lenses intersect to form a lens as in FIG. 14, the phase profiles of the respective sub-lenses may also intersect in the intersection area 1410. The intersection area is processed, so that the entire lens may be positioned on the same plane. When a lens is formed as in FIG. 14, since focal points of the lens are out of line, a phased array antenna may achieve a high antenna gain not only when transmitting a beam steered in the horizontal direction but also when transmitting a beam steered in the vertical direction.

Figure 15A:
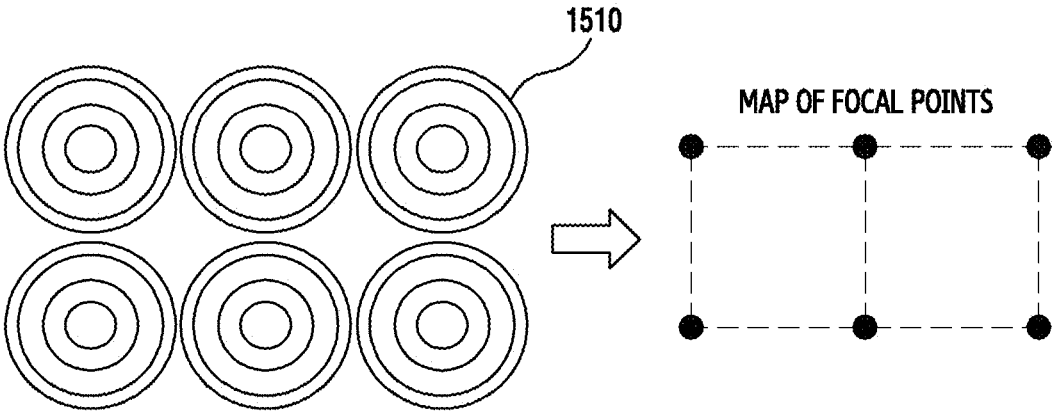
FIGS. 15A to 15C illustrate an example map of focal points obtained from a plurality of sub-lenses forming a lens according to various exemplary embodiments of the present disclosure.
Figure 15B:
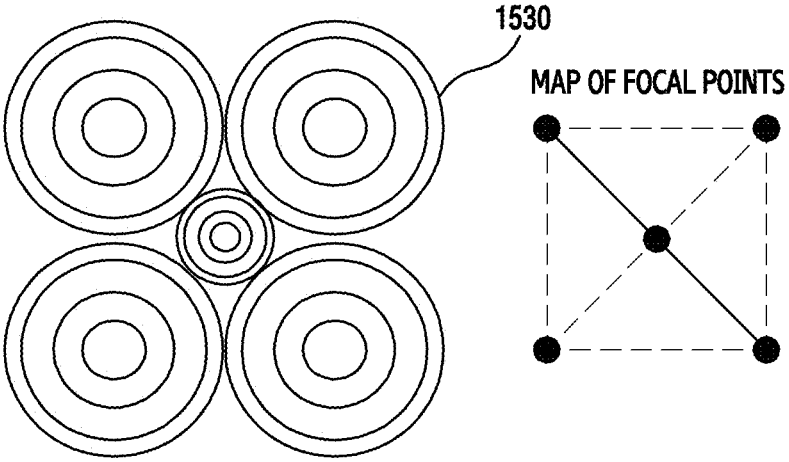
Figure 15C:
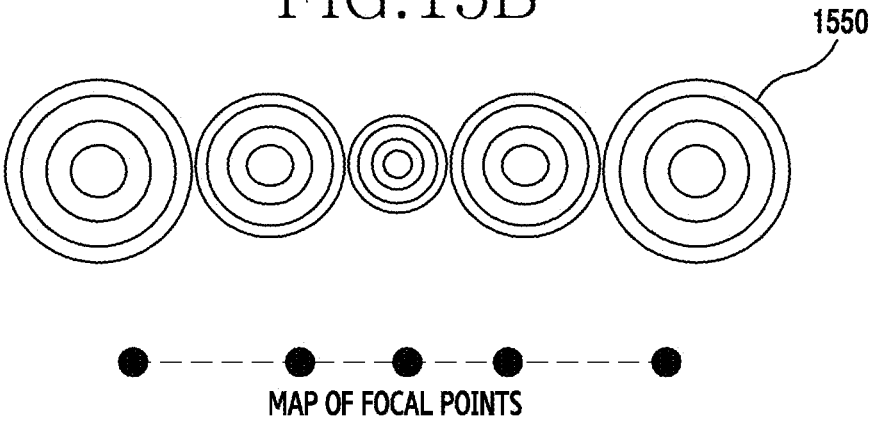

FIGS. 15A to 15C illustrate an example map of focal points obtained from a plurality of sub-lenses forming a lens according to various exemplary embodiments of the present disclosure. A map of focal points shows the positions of focal points in a lens with a plurality of focal points. A map of focal points enables the prediction of a coverage area for obtaining a high antenna gain when a phased array antenna transmits a beam using a lens.

FIG. 15A illustrates a lens 1510 formed of six neighboring circular sub-lenses and a map of focal points of the lens 1510. The sub-lenses forming the lens 1510 have the same size. The focal points of the lens 1510 may be positioned at the centers of the respective sub-lenses forming the lens 1510. The focal points included in the lens 1510 are indicated by dots, and a dotted line connects the dots, thereby obtaining a map of focal points as in FIG. 15A.

FIG. 15B illustrates a lens 1530 formed of five neighboring circular sub-lenses and a map of focal points of the lens 1530. Among the five sub-lenses forming the lens 1530, four sub-lenses have the same size, and the remaining one sub-lens has a smaller size than the other sub-lenses. The lens 1530 may be formed such that the four sub-lenses with the same size are cyclically arranged and the remaining one sub-lens is positioned among the cyclically arranged sub-lenses to be adjacent to the four sub-lenses. The focal points of the lens 1530 may be positioned at the centers of the respective sub-lenses forming the lens 1530. The focal points included in the lens 1530 are indicated by dots, and a dotted line connects the dots, thereby obtaining a map of focal points as in FIG. 15B.

FIG. 15C illustrates a lens 1550 formed of five neighboring circular sub-lenses and a map of focal points of the lens 1550. The focal points of the lens 1550 may be positioned at the centers of the respective sub-lenses forming the lens 1550. The five sub-lenses forming the lens 1550 are arranged in a line. That is, the focal points included in the lens 1550 are in line. Regarding the sizes of the sub-lenses forming the lens 1550 with reference to FIG. 15C, symmetrically positioned sub-lenses based on a middle sub-lens have the same size. Two sub-lenses at the opposite ends of the lens 1550 have the greatest size, the middle sub-lens has the smallest size, and the remaining two sub-lenses have a medium size. The focal points included in the lens 1550 are indicated by dots, and a dotted line connects the dots, thereby obtaining a map of focal points as in FIG. 15C. Referring to FIG. 15C, there are different distances between the focal points included in the lens 1550, which are short or long.

Figure 16:
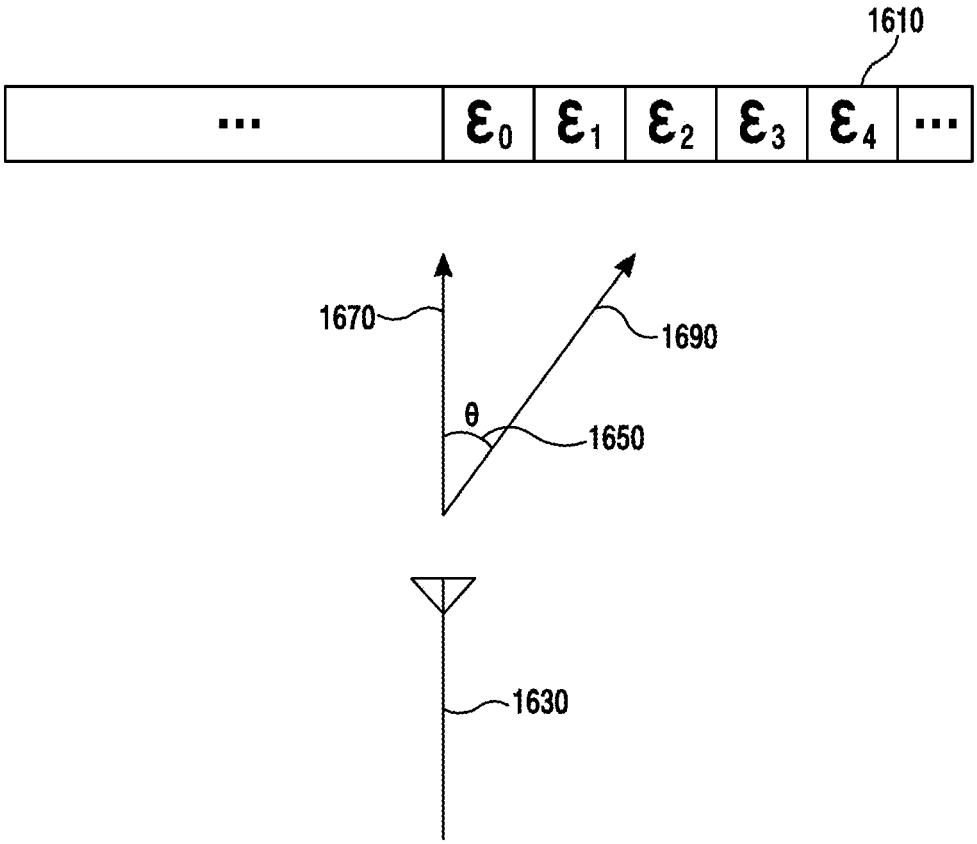
FIG. 16 illustrates example unit cells forming a lens according to an exemplary embodiment of the present disclosure.

FIG. 16 illustrates example unit cells forming a lens according to an exemplary embodiment of the present disclosure.

FIG. 16 shows a phased array antenna 1630, a lens 1610 disposed in front of the phased array antenna, an angle 1650 of a beam steered by the phased array antenna, and directions 1670 and 1690 in which the phased array antenna transmits a beam. In the present embodiment, it is assumed that the lens 1610 has a circular plane shape. FIG. 16 shows a lateral side of the lens 1610.

The lens 1610 may include, for example, a plurality of unit cells. In FIG. 16, the unit cells forming the lens 1610 are indicated by squares, respectively. Further, FIG. 16 shows that the unit cells of the lens are arranged in the horizontal direction to form one layer, which is merely an example. The lens 1610 may be formed in a plurality of layers of unit cells. When the lens 1610 includes a plurality of layers of unit cells, a variable element, such as a variable inductor and a variable capacitor, may be disposed between the layers. The plurality of unit cells of the lens 1610 may each have a different dielectric constant. FIG. 16 illustrates that the unit cells of the lens 1610 have dielectric constants $\varepsilon_0$, $\varepsilon_1$, $\varepsilon_2$, $\varepsilon_3$, and $\varepsilon_4$, respectively. A compensated phase value of each radio-wave component of a beam incident to a unit cell may vary depending on the dielectric constant of the unit cell. Specifically, as the dielectric constant of a unit cell increases, a compensated phase value of a radio-wave component of a beam incident to the unit cell is great. For example, when a central unit cell of the lens 1610 has the highest dielectric constant and a unit cell more distant from the center of the lens 1610 has a lower dielectric constant, the lens 1610 may have a phase profile as illustrated in FIG. 7B. That is, the phase profile of the lens 1610 has the local maximum value at the center of the lens, and the focal point of the lens is positioned at the center. In FIG. 7B, unit cells at the same distance from the center of the lens 1610 in the horizontal direction have the same dielectric constant, while unit cells more distant from the center of the lens 1610 may have lower dielectric constants. For another example, when a unit cell positioned in a direction 1690 has the highest dielectric constant $\varepsilon_2$ and a unit cell more distant from the unit cell positioned in the direction 1690 has a lower dielectric constant, the focus is positioned in the unit cell with the dielectric constant $\varepsilon_2$.

The phased array antenna 1630 may steer a beam to be transmitted in a direction 1670. Further, the phased array antenna 1630 may transmit a beam in the direction 1690 by changing the beam steering angle 1650. The lens 1610 may include unit cells to compensate the phases of radio-wave components reaching different unit cells such that the beam steered and transmitted in the direction 1670 passes through the lens to form a plane wave having a wave front perpendicular to the direction 1670. Further, the lens 1610 may include unit cells to compensate the phases of radio-wave components reaching different unit cells such that the beam steered and transmitted in the direction 1690 passes through the lens to form a plane wave having a wave front perpendicular to the direction 1690. That is, the dielectric constants of the unit cells of the lens 1610 may be set such that the focal point is formed at a spot that the beam transmitted in the direction 1670 reaches, or may be set such that the focal point is formed at a spot that the beam transmitted in the direction 1690. The position of the focal point of the lens 1610 may vary depending on the set dielectric constants of the unit cells forming the lens 1610.

Figure 17A:
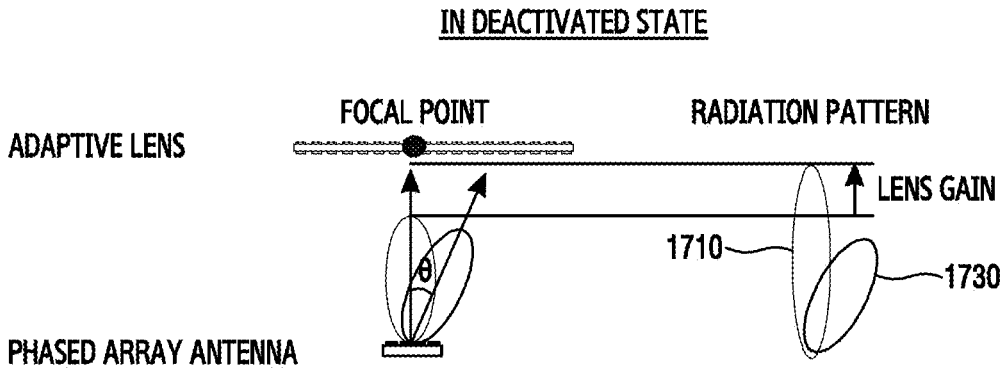
FIGS. 17A and 17B illustrate an example adaptive lens according to an exemplary embodiment of the present disclosure.
Figure 17B:
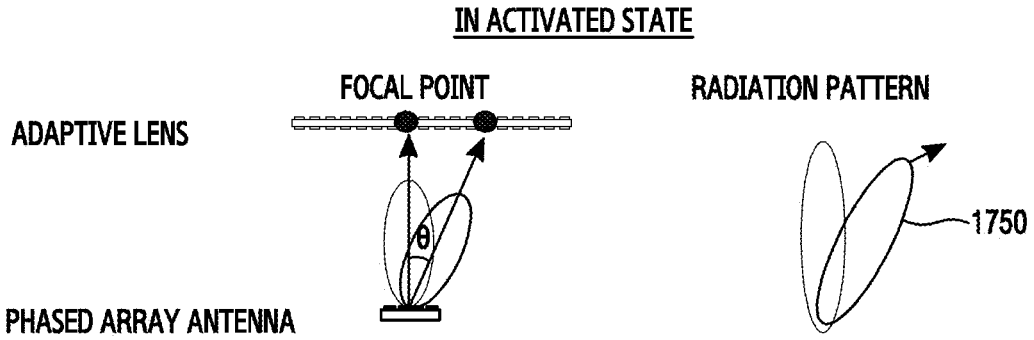

FIGS. 17A and 17B illustrate an example adaptive lens according to an exemplary embodiment of the present disclosure.

For example, the lens may include a plurality of unit cells. The unit cells of the lens may form a layer, and the lens may have a structure in which the unit cells are stacked in a plurality of layers. Variable elements, such as variable inductors and/or variable capacitors, may be disposed between the layers of the unit cells. The values of the variable elements may be changed by a control signal. The phase of a radio-wave component incident to a unit cell in which a variable element is positioned may be changed according to the value of the variable element. That is, the lens may variously change the values of the variable elements disposed between the layers of the unit cells using a control signal, thereby variously changing the phase profile of the lens.

For another example, the lens may include liquid crystal panels in layers. A dielectric with a specified dielectric constant may be disposed between the layers of the liquid crystal panels. Further, only an air layer may be present between the layers of the liquid crystal panels, instead of a dielectric. A voltage may be applied between the layers of the liquid crystal panels by a control signal. A dielectric constant between layers to which the voltage is applied may be changed according to the voltage applied between the layers of the liquid crystal panels. That is, the lens may apply different levels of voltage between layers of liquid crystal panels in each area of the lens using a control signal, thereby changing the phase profile of the lens.

Hereinafter, a change by a control signal in values of the variable elements disposed between the layers of the unit cells of the lens or a change in phase profile of the lens by a voltage applied to the layers of the liquid crystal panels of the lens is defined as the activation of the lens. Further, the lens that is capable of being activated is defined as an adaptive lens. Blocking a control signal to the activated lens is defined as deactivation. The lens may be activated by a control signal to have a plurality of focal points, and at least one focal point among the plurality of focal points may be relocated to a different position by a change in control signal in the activated state.

FIG. 17A illustrates the gain of a phased array antenna according to a beam steering direction in the deactivated lens. In the present embodiment, it is assumed that the deactivated lens has one focal point. Referring to FIG. 17A, the focal point of the lens is positioned in a direction perpendicular to the phased array antenna. Beams 1710 and 1730 respectively represent a beam transmitted by the phased array antenna towards the focal point of the lens and a beam transmitted in a direction deviating at an angle of θ from the focal point of the lens. Further, the size of an ellipse corresponding to each of the beams 1710 and 1730 may represent, for example, the power of each beam having passed through the lens. In FIG. 17A, the beam 1710 passes through the focal point of the lens and thus has a relatively high power after passing through the lens, whereas the beam 1730 passes through a spot other than the focal point of the lens and thus has a relatively low power after passing through the lens.

FIG. 17B illustrates the gain of the phased array antenna according to a beam steering direction in the activated lens. Referring to FIG. 17B, the lens includes not only the original focal point positioned at the center of the lens but also a focal point present in the direction at an angle of θ when activated by a control signal. In FIG. 17B, not only a beam steered to be transmitted to the focal point positioned at the center of the lens but also a beam 1750 steered to be transmitted in the direction at an angle of θ may have a relatively high power after passing through the lens.

The adaptive lens may adaptively relocate the focal point of the lens according to a beam steering direction of the phased array antenna, thus allowing the phased array antenna to obtain a high antenna gain regardless of a beam steering direction. That is, using the adaptive lens makes it possible to increase coverage for the phased array antenna to obtain a high gain.

The present embodiment shows that the adaptive lens is realized by changing the value of a variable element disposed between layers of unit cells or by changing the level of voltage applied between layers of liquid crystal panels, which is merely an example. The adaptive lens may be realized in various manners such that the phase profile of the lens may be changed by a control signal.

Figure 18:
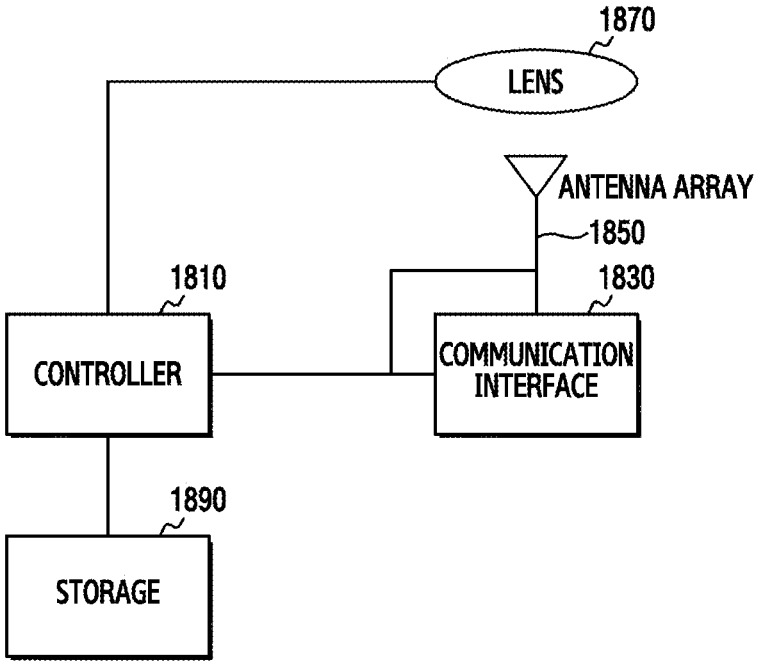
FIG. 18 illustrates an example transmitting apparatus according to an exemplary embodiment of the present disclosure.

FIG. 18 illustrates an example block diagram of a transmitting apparatus according to an exemplary embodiment of the present disclosure.

Referring to FIG. 18, the transmitting apparatus may include a communication interface 1830, a controller 1810, an antenna array 1850, a lens 1870, and a storage 1890. However, the transmitting apparatus is not limited to a configuration including only the foregoing components. For example, the transmitting apparatus may another component in addition to the communication interface 1830, the controller 1810, the antenna array 1850, the lens 1870, and the storage 1890. Further, the transmitting apparatus may include only some of the communication interface 1830, the controller 1810, the antenna array 1850, the lens 1870, and the storage 1890. For example, the transmitting apparatus may include only the controller 1810, the antenna array 1850, and the lens 1870, which are directly involved in controlling and transmitting a beam. When the lens 1870 is not an adaptive lens, the transmitting apparatus may include only the antenna array 1850 and the lens 1870 without the controller 1810.

The communication interface 1830 performs functions for transmitting and receiving a signal through a radio channel. The communication interface 1830 may include a transmitting filter, a receiving filter, an amplifier, a mixer, an oscillator, a DAC, an ADC, or the like. Further, the communication interface 1830 may include a plurality of radio frequency (RF) chains. The communication interface 1830 may perform beamforming. For beamforming, the communication interface 1830 may adjust the phases and strengths of respective signals transmitted and received through at least one antenna 1850 or antenna elements. In addition, the communication interface 1830 may include a plurality of communication modules to support a plurality of different radio access technologies. As described above, the communication interface 1830 transmits and receives signals. Accordingly, the communication interface 1830 may be referred to as a transmitter, a receiver, or a transceiver. The transmitting apparatus may be included as a component in another device. For example, the transmitting apparatus may be included in a base station.

The controller 1810 controls overall operations of the transmitting apparatus. For example, the controller 1810 transmits and receives signals through the communication interface 1830. Further, the controller 1810 records and reads data in the storage 1890. To this end, the controller 1810 may include at least one processor. For example, the controller 1810 may include a CP to perform control for communication and an AP to control a higher layer, such as an application program. The controller 1810 may transmit a control signal to the lens 1870 to activate the lens 1870. That is, the controller 1810 may transmit a control signal to the lens 1870, thereby allowing the lens to have a plurality of focal points or relocating at least one of a plurality of focal points of the lens to a different position. In addition, when the lens 1870 includes a plurality of layers each including a plurality of unit cells, the controller 1810 may change the value of at least one inductor or at least one capacitor disposed between the plurality of layers using a control signal. The position of a focal point in the lens 1870 may be changed according to the changed value of the at least one inductor or at least one capacitor. When the lens 1870 includes a plurality of layers each including a liquid crystal panel, the controller 1810 may change a voltage between panels using a control signal. The position of a focal point in the lens 1870 may be changed according to the changed voltage. The controller 1810 may control the antenna array 1850.

The antenna array 1850 may include a plurality of antenna elements. The antenna array 1850 may steer a beam using the antenna elements. Each of the antenna elements may have a corresponding phase shifter. A beam transmitted from the antenna array 1850 may be steered by the antenna elements shifting the phases of sub-signals forming the beam.

The lens 1870 may concentrate a beam transmitted from the antenna array 1850 in a specified direction. The lens 1870 may include a plurality of unit cells. Specifically, the lens 1870 may have a structure in which the plurality of unit cells is stacked in layers. At least one capacitor or at least one inductor may be disposed between layers of the unit cells. Alternatively, the lens 1870 may include a plurality of layers each including a liquid crystal panel. A voltage may be applied between panels. The lens 1870 may have various forms. For example, the lens 1870 may be a plane, a circular plane, or a segmented circle-shaped plane. Further, the lens 1870 may have a rectangular shape or octagonal shape. The lens 1870 is not limited to the foregoing shapes in the present disclosure.

The lens 1870 may have a plurality of focal points. For example, the lens 1870 may have a plurality of focal points by disposing a plurality of sub-lenses each having one focal point to be adjacent or to intersect. The respective sub-lenses may have different sizes. For another example, the lens 1870 may have a plurality of focal points by a plurality of unit cells of the lens 1870 having different dielectric constants. Among the plurality of unit cells, unit cells included in a first part may have the same dielectric constant and unit cells included in a second part may have the same dielectric constant, in which the dielectric constant of the first part may be different from the dielectric constant of the second part. For still another example, at least one focal point of the lens 1870 is activated by a control signal, thereby allowing the lens 1870 to have a plurality of focal point. When the lens 1870 has a structure in which the plurality of unit cells is stacked in layers, the transmitting apparatus may change the value of at least one capacitor or at least one inductor disposed between layers of unit cells to activate at least one focal point of the lens 1870 or to relocate an activated focal point. Further, when the lens 1870 includes a plurality of layers each including a liquid crystal panel, the transmitting apparatus may change a voltage between panels to activate at least one focal point of the lens 1870 or to relocate an activated focal point. The plurality of focal points of the lens 1870 may be out of line. That is, the plurality of focal point may be positioned on a two-dimensional plane or in three dimensions to cover a beam steered in different directions.

The lens 1870 may compensate for a phase error of a beam steered towards each focal point at the focal point. A phase error refers to a phase of each radio-wave component of a beam to be compensated such that the beam forms a plane wave after passing through the lens 1870. The phase error of the beam steered towards the focal point of the lens 1870 may be properly compensated, so that the beam may form a plane wave after passing through the lens 1870. The lens 1870 may have a phase profile to compensate the phase error of the beam steered towards the focal point of the lens 1870. The phase profile of the lens 1870 has the local maximum value at each focal point of the lens 1870.

The storage 1890 stores a basic program for an operation of a transmitting end, an application program, and data including configuration information. In particular, the storage 1890 may store data for signaling with the transmitting end, that is, data for interpreting a message from the transmitting end. The storage 1890 provides stored data according to a request from the controller 1810.

Figure 19A:
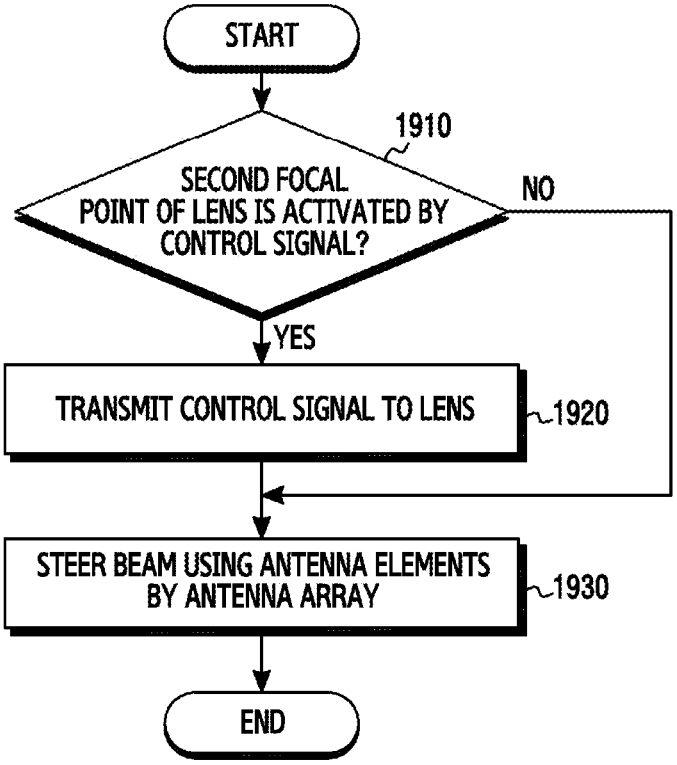
FIGS. 19A and 19B illustrate a flowchart of a process in which a transmitting apparatus transmits a beam according to an exemplary embodiment of the present disclosure.
Figure 19B:
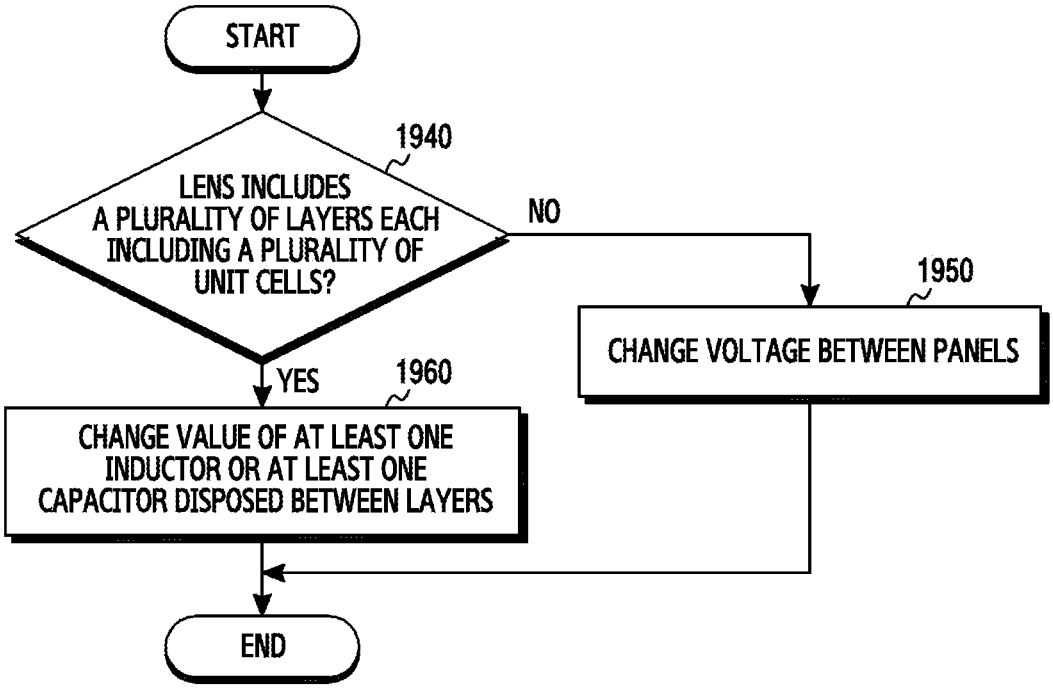

FIGS. 19A and 19B illustrate a flowchart of a process in which a transmitting apparatus transmits a beam according to an exemplary embodiment of the present disclosure. In the present embodiment, the transmitting apparatus may include an antenna array that steers a beam using antenna elements and a lens having a first focal point and a second focal point.

FIG. 19A is a flowchart illustrating a process in which the antenna array of the transmitting apparatus transmits a beam through the lens.

In operation 1910, the transmitting apparatus determines whether it is possible to activate the second focal point of the lens by a control signal. That is, the transmitting apparatus determines whether the lens is an adaptive lens.

When it is determined that the lens is an adaptive lens in operation 1910, the transmitting apparatus transmits a control signal to the lens in operation 1920. The second focal point may be generated by the control signal in the lens at a position towards which the transmitting apparatus is to transmit a beam or be relocated by the control signal to a position towards which the transmitting apparatus is to transmit a beam.

The transmitting apparatus steers a beam using the antenna elements by the antenna array in operation 1930. The antenna array may generate the beam at a position in the lens towards which the transmitting apparatus is to transmit the beam or may steer the beam toward the relocated focal point. The beam transmitted from the antenna array may be steered, for example, by shifting the phase of each sub-signal forming the beam by the antenna elements. The antenna array may transmit the beam in the beam-steered direction, and the transmitted beam may propagate in a specified direction after passing through the lens.

When it is determined that it is impossible to activate the second focal point of the lens by the control signal, that is, when the lens is not an adaptive lens in operation 1910, the transmitting apparatus steers a beam using the antenna elements by the antenna array in operation 1930. The beam is transmitted through the lens with the plurality of focal points, thus having a high gain even though being steered in different directions. That is, when the beam is transmitted through the lens with the plurality of focal points, coverage to transmit the beam with a high gain is wide.

The flowchart in FIG. 19A illustrates that the antenna array of the transmitting apparatus transmits a beam through the lens both in the case where the lens is an adaptive lens and in the case where the lens is not an adaptive lens. This is for the convenience of description, and the respective cases may be illustrated in separate flowcharts. For example, when the lens is not an adaptive lens, the process in which the antenna array transmits a beam may include only operation 1930. Further, when the lens is an adaptive lens, the process in which the antenna array transmits a beam may include only operations 1920 and 1930.

FIG. 19B is a flowchart illustrating a process in which a focal point is generated or relocated in an adaptive lens by a control signal.

In operation 1940, the transmitting apparatus determines that the adaptive lens includes a plurality of layers each including a plurality of unit cells. In the present embodiment, when the adaptive lens does not include a plurality of layers each including a plurality of unit cells, it is assumed that the adaptive lens includes a plurality of layers each including a liquid crystal panel. This is merely an example, and the adaptive lens may be formed in various manners such that the phase profile of the lens may be changed by a control signal.

When it is determined that the adaptive lens includes a plurality of layers each including a plurality of unit cells in operation 1940, the transmitting apparatus may change the value of at least one inductor or at least one capacitor disposed between layers of unit cells using a control signal in operation 1960. The position of at least one second focal point in the adaptive lens may be generated or changed according to the value of the at least one inductor or at least one capacitor.

When it is determined that the adaptive lens does not include a plurality of layers each including a plurality of unit cells in operation 1940, that is, when the adaptive lens includes a plurality of layers each including a liquid crystal panel, the transmitting apparatus may change a voltage between layers of liquid crystal panels in operation 1950. The position of at least one second focal point in the adaptive lens may be generated or changed according to the voltage.

The methods described in the claims or the specification of the present disclosure can be implemented using hardware and software alone or in combination.

Any such software may be stored in a computer readable storage medium. The computer readable storage medium stores one or more programs (software modules) including instructions, which when executed by at least one processor in a UE, cause the UE to perform a method of the present disclosure.

Any such software may be stored in the form of volatile or non-volatile storage such as read only memory (ROM), or in the form of memory such as random access memory (RAM), memory chips, device, or integrated circuits, or on an optically or magnetically readable medium such as a compact disc (CD)-ROM, digital versatile disc (DVD), magnetic disk or magnetic tape or the like.

It will be appreciated that the storage devices and storage media are embodiments of machine-readable storage that are suitable for storing a program or programs comprising instructions that, when executed, implement embodiments of the present disclosure. Accordingly, embodiments provide a program comprising code for implementing apparatus or a method as claimed in any one of the claims of this specification and a machine-readable storage storing such a program. Still further, such programs may be conveyed electronically via any medium such as a communication signal carried over a wired or wireless connection and embodiments suitably encompass the same.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An apparatus in a wireless communication system, the apparatus comprising:

an antenna array configured to steer a first beam using antenna elements; and a lens including a first focal point and a second focal point, wherein the lens is configured to generate a second beam of a plane wave by compensating for a phase error of the steered first beam passing through at least one of the first focal point or the second focal point, wherein the lens is configured by disposing a first sub-lens including the first focal point, a second sub-lens including the second focal point, and a third sub-lens including a third focal point to be adjacent, and wherein each of the first sub-lens, the second sub-lens, and the third sub-lens has a circular-planar shape.

2. The apparatus of claim 1, wherein at least two of the first sub-lens, the second sub-lens, or the third sub-lens have different sizes.

3. The apparatus of claim 1, wherein the first sub-lens has a circular-planar shape, and the second sub-lens and the third sub-lens have a segmented circular-planar shape, respectively.

4. The apparatus of claim 1, wherein the lens is configured to comprise a plurality of unit cells, and wherein a dielectric constant of first part of the plurality of unit cells is different than a dielectric constant of second part of the plurality of unit cells.

5. The apparatus of claim 1, wherein a phase profile of the lens has two local maximum values corresponding to the first focal point and the second focal point, respectively.

6. The apparatus of claim 1, further comprising a controller configured to transmit a control signal to the lens, wherein the second focal point is activated by the control signal.

7. The apparatus of claim 6, wherein a position of the second focal point in the lens is changed based on the control signal.

8. The apparatus of claim 6, wherein, if the lens is configured to comprise a plurality of layers each of which comprises a plurality of unit cells, the controller is configured to change a value of at least one of an inductor or a capacitor disposed between the layers using the control signal, and wherein a position of the second focal point in the lens is changed according to the value of the at least of the inductor or the capacitor.

9. The apparatus of claim 6, wherein, if the lens is configured to comprise a plurality of layers each of which comprises a liquid crystal panel, the controller is configured to change a voltage between the panels included in the plurality of layers using the control signal, and wherein a position of the second focal point in the lens is changed according to the voltage.

10. A method for operating a transmitting end in a wireless communication system, the method comprising:

steering, by an antenna array, a first beam using antenna elements; and generating a second beam of a plane wave by compensating for a phase error of the steered first beam passing through at least one of a first focal point or a second focal point comprised in a lens, wherein the lens is configured by disposing a first sub-lens including the first focal point, a second sub-lens including the second focal point, and a third sub-lens including a third focal point to be adjacent, and wherein each of the first sub-lens, the second sub-lens, and the third sub-lens has a circular-planar shape.

11. The method of claim 10, wherein at least two of the first sub-lens, the second sub-lens, or the third sub-lens have different sizes.

12. The method of claim 10, wherein the first sub-lens has a circular-planar shape, and the second sub-lens and the third sub-lens have a segmented circular-planar shape, respectively.

13. The method of claim 10, wherein the lens is configured to comprise a plurality of unit cells, and wherein a dielectric constant of first part of the plurality of unit cells is different than a dielectric constant of second part of the plurality of unit cells.

14. The method of claim 10, wherein a phase profile of the lens has two local maximum values corresponding to the first focal point and the second focal point, respectively.

15. The method of claim 10, further comprising transmitting a control signal to the lens, wherein the second focal point is activated by the control signal.

16. The method of claim 15, wherein a position of the second focal point in the lens is changed based on the control signal.

17. The method of claim 15, further comprising:

if the lens comprises a plurality of layers each of which comprises a plurality of unit cells, changing a value of at least one of an inductor or a capacitor disposed between the layers using the control signal, wherein a position of the second focal point in the lens is changed according to the value of the at least one of the inductor or the capacitor.

18. The method of claim 15, further comprising:

if the lens comprises a plurality of layers each of which comprises a liquid crystal panel, changing a voltage between the panels included in the plurality of layers using the control signal, wherein a position of the second focal point in the lens is changed according to the voltage.

* * * * *